US011534044B2

(12) United States Patent
Nieschwitz et al.

(10) Patent No.: US 11,534,044 B2
(45) Date of Patent: Dec. 27, 2022

(54) VACUUM INLET VALVE ASSEMBLY WITH A CLOSEABLE SEAL

(71) Applicant: H-P Products, Inc., Louisville, OH (US)

(72) Inventors: Darrell V. Nieschwitz, Louisville, OH (US); Greg A. Calderone, Canton, OH (US); Shawn C. Metz, Louisville, OH (US)

(73) Assignee: H-P PRODUCTS, INC., Louisville, OH (US)

( * ) Notice: Subject to any disclaimer, the term of this patent is extended or adjusted under 35 U.S.C. 154(b) by 210 days.

(21) Appl. No.: 16/806,543

(22) Filed: Mar. 2, 2020

(65) Prior Publication Data

US 2020/0281431 A1 Sep. 10, 2020

Related U.S. Application Data

(60) Provisional application No. 62/813,278, filed on Mar. 4, 2019.

(51) Int. Cl.
*A47L 9/24* (2006.01)
*A47L 5/38* (2006.01)

(52) U.S. Cl.
CPC ..... *A47L 9/242* (2013.01); *A47L 5/38* (2013.01)

(58) Field of Classification Search
CPC ... A47L 9/242; A47L 5/38; A47L 9/24; A47L 9/246; A47L 9/248; Y10T 137/698; Y10T 137/3331; Y10T 137/6918; Y10T 137/6943; Y10T 137/7846
See application file for complete search history.

(56) References Cited

U.S. PATENT DOCUMENTS 2,701,103 A * 2/1955 Coleman ..... F24D 5/02 454/236
2,943,698 A 7/1960 Bishop
2,953,806 A 9/1960 Walker
3,173,164 A 3/1965 Congdon
3,520,725 A 7/1970 Hamrick
3,565,103 A * 2/1971 Maselek ..... F16K 1/2028 285/137.11
3,672,630 A * 6/1972 Naumburg ..... F16K 1/2014 251/303
4,336,427 A 6/1982 Lindsay
4,688,596 A * 8/1987 Liebmann ..... A47L 5/38 248/27.3
5,263,502 A * 11/1993 Dick ..... A47L 9/242 137/15.17
5,535,784 A * 7/1996 Saville ..... F16K 1/205 251/147

(Continued)

*Primary Examiner* — Anne M Kozak
*Assistant Examiner* — Christopher Soto
(74) *Attorney, Agent, or Firm* — Sand, Sebolt & Wernow Co., LPA

(57) ABSTRACT

A closure flap on a vacuum inlet valve assembly or housing pivots between an open first position and a closed second position. When the closure flap is in the open first position, it is offset from a central longitudinal axis of the vacuum inlet valve housing. When the closure flap is in the closed second position, it intersects the central longitudinal axis. The closure flap has a resilient and compressible protrusion that releasable locks the closure flap in each position.

19 Claims, 20 Drawing Sheets

(56) References Cited

U.S. PATENT DOCUMENTS

| | | | | |
|---|---|---|---|---|
| 5,914,816 | A * | 6/1999 | Soto | G02B 7/002 359/822 |
| 6,459,056 | B1 | 10/2002 | Graham | |
| 7,010,829 | B2 | 3/2006 | Harman et al. | |
| 7,624,472 | B2 | 12/2009 | Ambrose | |
| 8,001,650 | B2 | 8/2011 | Trotter | |
| 9,993,126 | B2 * | 6/2018 | Harman | A47L 5/38 |
| 2015/0190023 | A1 | 7/2015 | Nieschwitz et al. | |
| 2017/0332858 | A1 | 11/2017 | Nieschwitz et al. | |
| 2018/0153364 | A1 | 6/2018 | Nieschwitz et al. | |
| 2020/0100634 | A1 | 4/2020 | Nieschwitz et al. | |
| 2020/0178745 | A1 | 6/2020 | Nieschwitz et al. | |
| 2020/0281431 | A1 | 9/2020 | Nieschwitz et al. | |
| 2021/0145226 | A1 | 5/2021 | Nieschwitz et al. | |
| 2021/0196091 | A1 | 7/2021 | Nieschwitz et al. | |

* cited by examiner

VACUUM INLET VALVE ASSEMBLY WITH A CLOSEABLE SEAL

CROSS REFERENCE TO RELATED APPLICATIONS

This application claims the benefit of U.S. Provisional Application Ser. No. 62/813,278, filed on Mar. 4, 2019; the disclosure of which is incorporated herein by reference.

TECHNICAL FIELD

The present disclosure relates to a vacuum inlet valve assembly for a central vacuum cleaning system. The vacuum inlet valve assembly includes a closure flap that pivots between an open position and a closed position after a hose has been disconnected from the vacuum inlet valve assembly for subsequent connection with a secondary vacuum inlet valve.

BACKGROUND

Background Information

Central vacuum cleaning systems for home and commercial use have been used for many years, examples of which are shown in U.S. Pat. Nos. 2,943,698, 3,520,725, 3,173,164, and 7,010,829. These systems generally are comprised of a main vacuum source, which is usually mounted in the basement or other location in the structure or closely adjacent thereto. The vacuum source is connected to various dedicated inlet valves in the structure by rigid conduits or tubing. These valves are usually mounted in a wall and secured to the adjacent structure by mounting flanges such as shown in U.S. Pat. Nos. 4,336,427, 6,459,056, and 7,624,472.

Many of these vacuum systems use lengths of flexible hose that are slidably contained within the vacuum conduit connected to a particular valve and slidably moveable therein so that the hose is pulled from the conduit through the inlet valve for cleaning an area adjacent the inlet valve and then retracted back into the conduit for storage after use. Some examples of such systems are shown in U.S. Pat. Nos. 2,953,806, 7,010,829, and 8,001,650.

In other vacuum cleaning systems, a single length of hose is stored in a closet or other storage area and then moved by the user between the various inlet valves after which it is then returned to the closet or other storage area. These prior system hoses have a relative length, for example 25 feet, and require considerable storage space and inconvenience for the user to retrieve it and then subsequently replace it in the storage area after a cleaning operation. Many homeowners will buy a second or third hose for storage in a closet or other storage area adjacent each of the inlet valves thereby increasing the cost of the system.

SUMMARY

Thus, it is desirable to provide a vacuum cleaning system and method in which a single hose can be used for the system and which can be conveniently stored in the conduit which connects to a primary valve and then selectively connected to the other secondary valves located throughout the structure increasing the convenience of the system and at a lower cost to the home owner. However, when the hose is removed from the primary valve needs to be adequately sealed to provide vacuum suction at the secondary valve.

Thus, a need continues to exist for an improve mechanism or method for sealing a primary valve in a central vacuum system. The present disclosure addresses these and other issues by providing a novel closure flap.

In one aspect, an exemplary embodiment of the present disclosure may provide a vacuum valve assembly comprising: a housing connected with a conduit defining an open end; a closure flap pivotably connected with the housing configure to move from an open first position to a closed second position to cover and seal the open end; a first surface on the flap that is offset generally parallel to a rear wall of the housing when the closure flap is in the open first position; a second surface on the flap spaced from the first surface; a tapered annular sidewall extending from the second surface to the first surface; a cantilevered pull tab having a first end connected to the second surface of the closure flap; a boss extending from the tapered annular sidewall defining a transversely aligned aperture through which a pivot pin extends and defines a pivot axis for the closure flap to pivot about; a projection extending from the boss that is compressible during movement of the flap between the open first position and the closed second position adapted to selectively and releasably lock the closure flap in the open first position and the closed second position; wherein the closure flap is formed as a unitary unibody monolithic member.

This exemplary embodiment or another exemplary embodiment may further include wherein the boss includes a convexly curved outer surface that is shaped complementarily to a concavely curved surface of a receiving area within a portion of the inlet. This exemplary embodiment or another exemplary embodiment may further include a concave recess defined in the concave surface having a smaller radius of curvature than that of concave surface, wherein when the closure flap is in the closed second position, the protrusion fits within the concave recess. This exemplary embodiment or another exemplary embodiment may further include wherein the pull tab extends outward from the second surface and includes a first end connected with the second surface and a terminal free end, and the first end is connected with the second surface adjacent a radial outermost or circumferential edge of the second surface. This exemplary embodiment or another exemplary embodiment may further include wherein the pull tab is oriented in a manner such that a connected first end is positioned more radially outward from a center of the closure flap than a terminal free end. This exemplary embodiment or another exemplary embodiment may further include wherein the terminal free end is spaced slightly above or apart from the second surface; and when the closure flap is in the open first position, the pull tab is positioned closely adjacent a rear wall of the valve assembly. This exemplary embodiment or another exemplary embodiment may further include wherein the open position of the closure flap is associated with being generally upright and vertical and parallel to a back wall of the assembly when the closure flap is opened.

In one aspect, an exemplary embodiment of the present disclosure may provide a closure flap comprising: a first major surface and an opposing second major surface, wherein the first major surface is larger than the second major surface; a tapered edge extending between the first major surface and the second major surface at an angle relative to a first axis that perpendicularly intersects the first major surface and the second major surface, and the tapered edge defining a minor surface that extends substantially circumferential around the first major surface and the second major surface; a boss extending outward from the tapered edge having two parallel sidewalls that are orthogonal to the first major surface and the second major surface, and the boss defining an aperture extending between the two parallel sidewalls orthogonal to the first axis; a second axis extending centrally through the aperture, wherein the second axis is offset orthogonal to the first axis, wherein the first major surface and the second major surface are pivot about the second axis between an open position and a closed position; a convex surface on the boss extending between the two parallel sidewalls; a protrusion on the boss, and the protrusion extending radially outward from the convex surface on the boss relative to the second axis, wherein the protrusion is convexly curved and has a radius of curvature less than that of the convex surface on the boss; and a cantilevered pull tab having a first end and a free second end, wherein the first end is connected to first major surface adjacent an outer circumferential edge thereof and wherein the free second end is closer to the first axis than the first end and the free second end is spaced apart from the first major surface.

In yet another aspect, an embodiment of the present disclosure may provide a method for a closure flap on a vacuum inlet valve housing comprising: removing a vacuum hose from a vacuum inlet valve housing, wherein the housing has central longitudinal axis; pivoting a closure flap about a pivot axis between an open first position and a closed second position; and wherein the closure flap is offset from the central longitudinal axis in the open first position and the closure flap intersect the central longitudinal axis in the closed second position. This exemplary method or another exemplary method may further provide compressing a protrusion on the closure flap when the closure flap is pivoting between the open first position and the closed second position; and expanding the protrusion to fit within a recess formed in the vacuum inlet valve housing when the closure flap is in the closed second position to releaseably lock the closure flap in the closed second position. This exemplary method or another exemplary method may further provide wherein the protrusion is formed from a resilient material that permits expansion and compression thereof, and wherein the closure flap's weight is insufficient to overcome a rigidity of the resilient material when nested within the recess, further comprising: imparting a force through physical manipulation to the closure flap that overcomes the rigidity of the resilient material to compress the protrusion while moving between the open first position and the closed second position. This exemplary method or another exemplary method may further provide wherein imparting a force is accomplished by pulling on a pull tab coupled in a cantilevered manner to a major surface on the closure flap. This exemplary method or another exemplary method may further provide positioning, when the closure flap is in the open first position, the protrusion lower than a concave frontal surface on the vacuum inlet valve housing. This exemplary method or another exemplary method may further provide sealing an open end defined by a lower end of a conduit of the vacuum inlet valve housing with a tapered wall on the closure flap.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
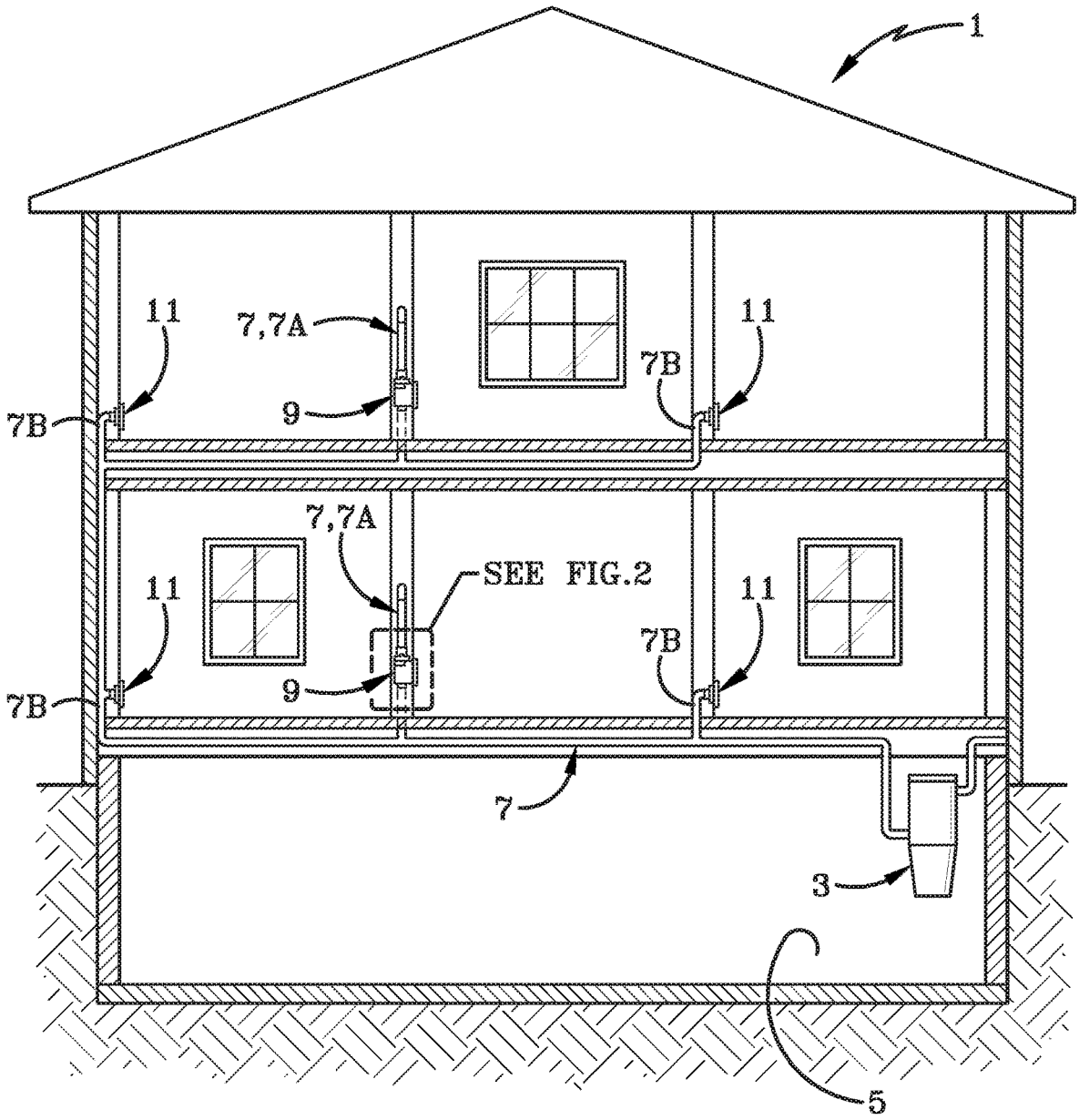
FIG. 1 is a diagrammatic view showing a structure having the improved vacuum cleaning system of the present disclosure located therein.
Figure 2:
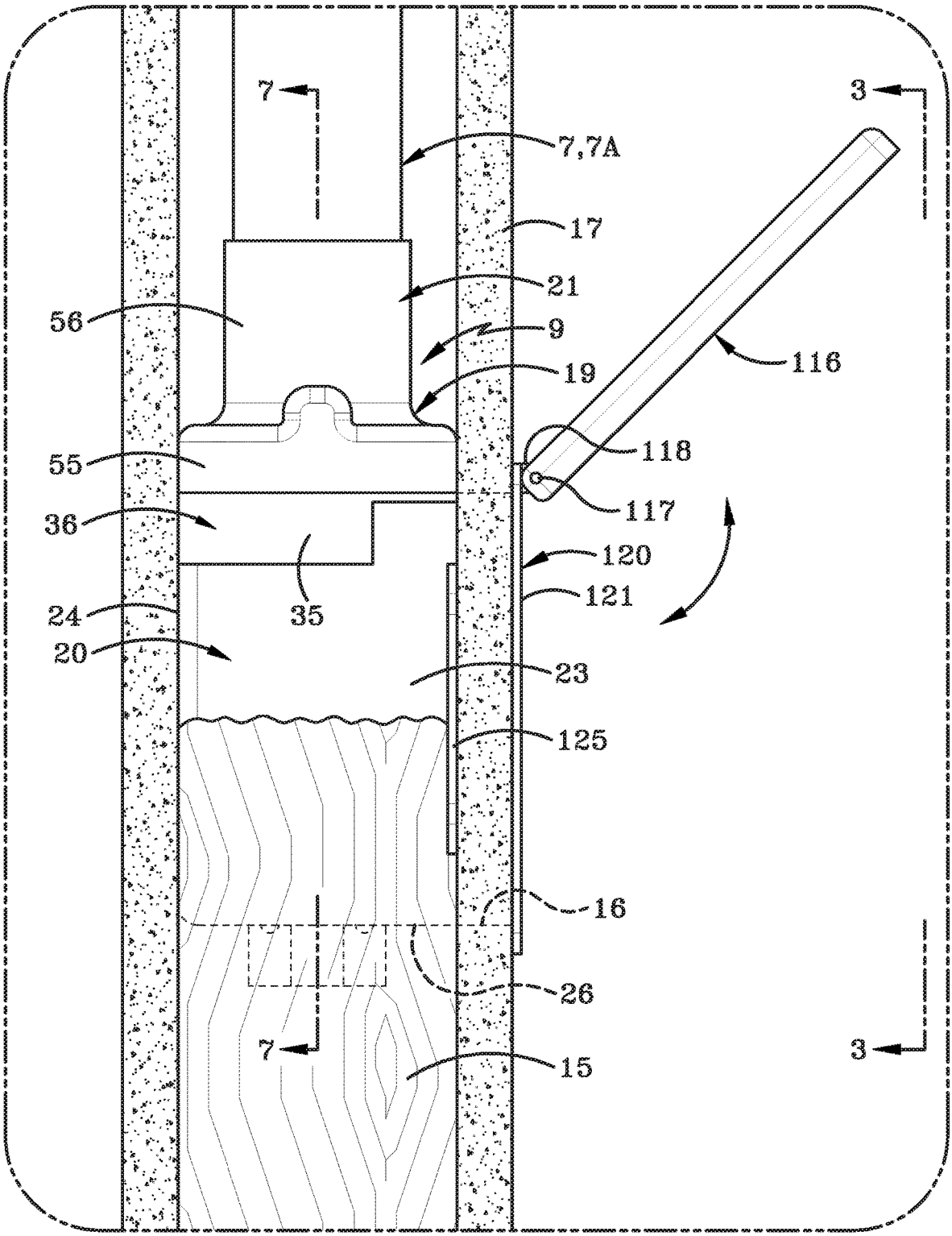
FIG. 2 is an enlarged view of the encircled portion in FIG. 1 showing the principal inlet valve of the vacuum cleaning system with portions broken away mounted in a wall opening with the closure door in an open position.

The central vacuum cleaning system of the present disclosure is indicated generally at 1 and is shown in FIG. 1. A central vacuum source 3 is located within a usual structure such as in a lower level 5 of a dwelling or could be located outside closely adjacent thereto, such as in a garage. A plurality of vacuum source tubes or conduits 7 extend from vacuum source 3 to various locations or rooms within the structure. The number of conduits will depend upon the size of the house, number of rooms, size of the vacuum source, and other factors. These vacuum supply conduits are usually formed of rigid plastic and in accordance with the present disclosure include a conduit 7A connected to a primary inlet valve indicated generally at 9, and by conduits 7B to a pair of secondary inlet valves indicated generally at 11, two of which are shown in FIG. 1 in the first floor of the dwelling and two in the top floor, the purpose of which is discussed further below.

Primary inlet valve 9 of the present disclosure is shown in detail in FIGS. 2-12. System 1 may further include a plurality of secondary inlet valves 11 located throughout the structure. Primary inlet valve 9 is shown mounted within a structure and connected to central vacuum source 3 by conduit 7A. Inlet valve 9 is shown attached to a wall stud 15 (FIGS. 2 and 3) and accessible through an opening 16 formed in an attached wallboard 17 such as drywall, used in a usual home construction. Primary inlet valve 9, as well as secondary inlet valves 11, can be used in various types of constructions and other structure locations than that shown in FIG. 1 within in the concept of the present disclosure.

Figure 4A:
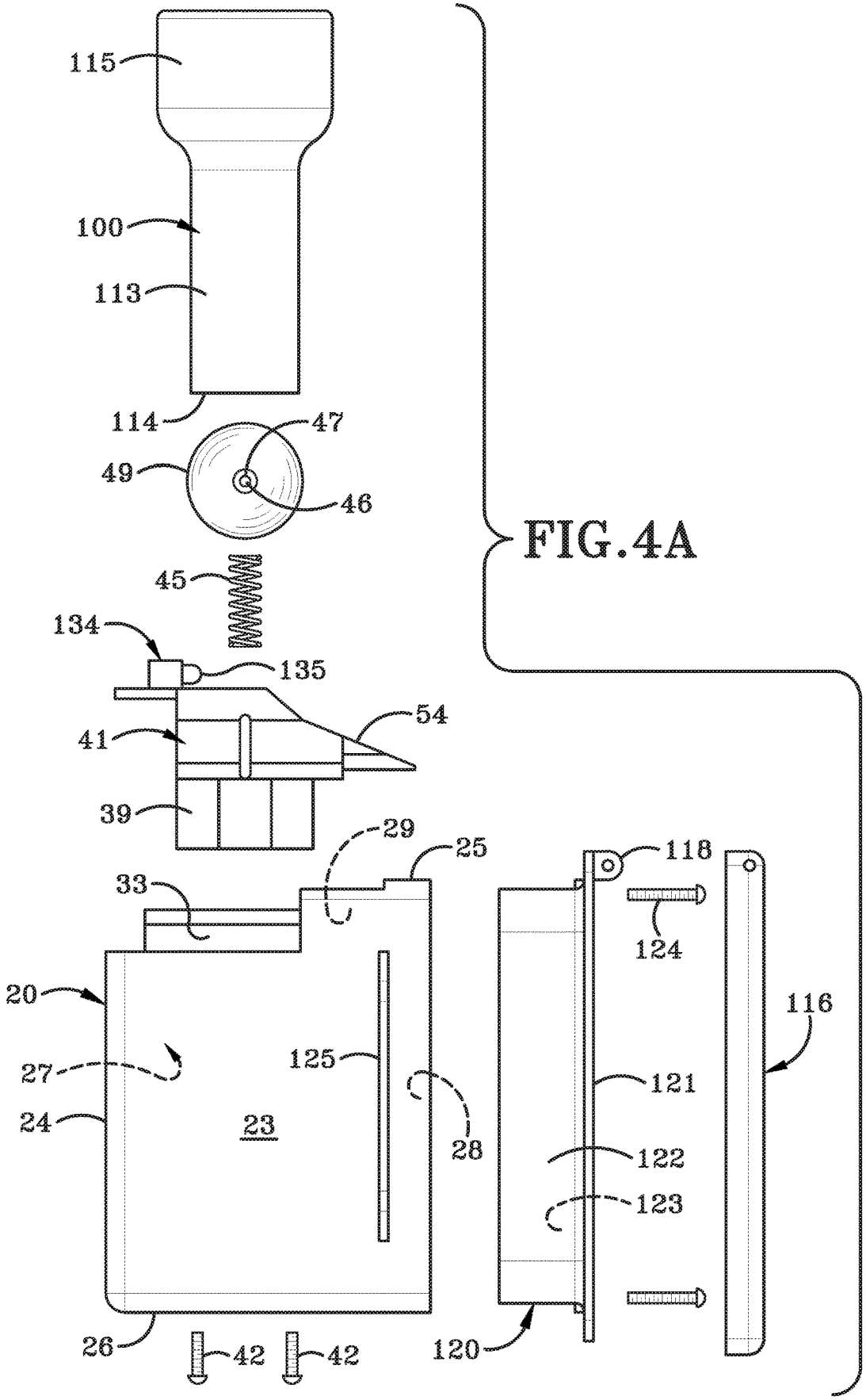
FIG. 4A is an exploded side elevational view showing many of the components in the lower portion of the primary inlet valve of FIGS. 1 and 2.
Figure 5A:
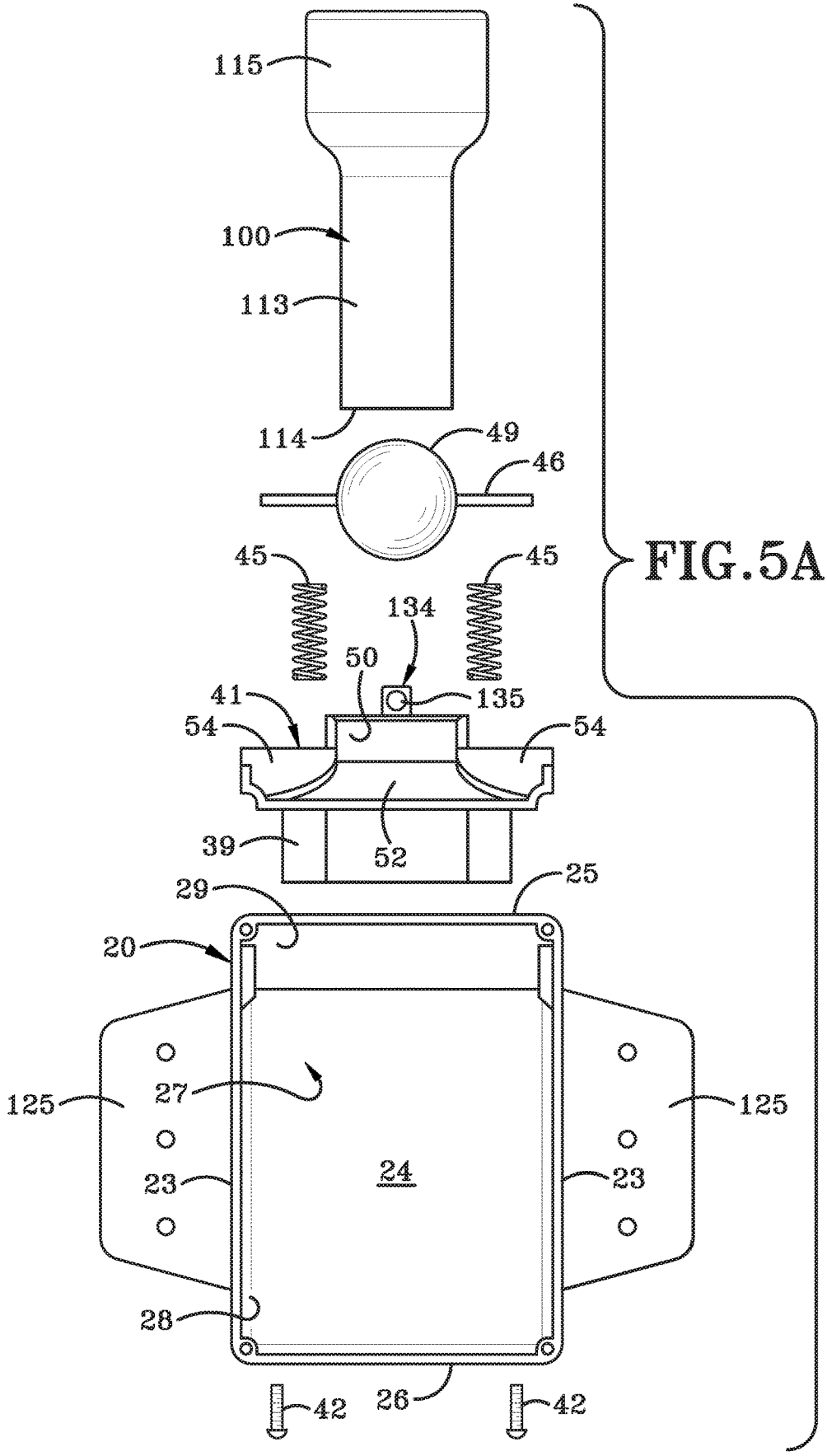
FIG. 5A is an exploded front elevational view of many of the components of the lower portion of the principal inlet valve as shown in FIG. 4A.

Primary inlet valve 9 includes a main body or housing indicated generally at 19, formed by a lower portion 20 and an upper portion 21. Lower portion 20 (FIGS. 4A and 5A) is formed by a pair of side walls 23, a rear wall 24, a top wall 25 and a bottom wall 26, which walls define an internal chamber 27 having a front or outlet end opening 28 and an open top 29. Lower portion 20 preferably will have a rectangular shape as shown in FIGS. 4A and 5A. In one exemplary embodiment, the lower portion 20 is defines an unsealed hosing that is open to the environment. Since the lower portion is unsealed, certain aspects of the hose 65 seal directly with the interior surface of the conduit 7 and seal directly with a ball seal 49 carried by the lower portion 20.

Upper portion 21 of housing 19 (FIGS. 4B and 5B) includes a box top 31 which is mounted on and encloses open top 29 of lower portion 20. The upper edges of side walls 23 of lower portion 20 are formed with U-shaped channels 33 (FIG. 4A) which slidably receives therein complementary-shaped channels 34 formed along sidewalls 35 of a lower rectangular-shaped bottom portion 36 of box top 31 to mount upper portion 21 on lower portion 20. This sliding engagement enables lower portion 20 and upper portion 21 of housing 19 to be produced independently preferably of a molded plastic, and then assembled after the various internal components thereof which are described below, are mounted respectively in lower portion 20 and upper portion 21.

An enlarged opening 38 (FIG. 6) is formed in bottom wall 26 of lower portion 20 of housing 19 and receives therein a generally rectangular portion 39 (FIG. 4A) of a bottom bracket 41 which is secured therein by screws 42. It is readily understood that rectangular portion 39 and complementary-shaped opening 38 can have other shapes such as round, oval, etc. Bracket 41 is formed with a pair of spaced vertically extending channels 44 (FIG. 7) in which is mounted a pair of compression coil springs 45. Springs 45 engage a horizontally extending pin 46 which extends through a diametric hole 47 formed in a ball 49. Ball 49 is located in a central channel 50 formed in bottom bracket 41. A downwardly extending ramp 52 (FIGS. 4A and 5A) is formed between a pair of spaced flanges 54 in which ball 49 is located. The purpose and function of bracket 41 and ball 49 are discussed further below.

Box top 31 (FIGS. 4B, 5B and 9), in addition to having a lower rectangular portion 36, includes a cylindrical intermediate portion 55 which is connected to an upper reduced diameter cylindrical top portion 56 by a horizontal annular portion 57 providing a bell-shaped configuration to box top 31. Box top 31 is formed with a hollow interior 58 which terminates in a top opening 59. Box top 31 preferably will be a one-piece molded plastic member as are portions 20 and 21 of housing 19. The hollow interiors 27 and 58 of lower portion 20 and box top 31 provide a through bore for inlet valve 9 which terminates in an inner open end defined by top opening 59 and an outer open end defined by front wall opening 28 of body 19 for the passage of a flexible hose 65 therethrough.

Figure 6:
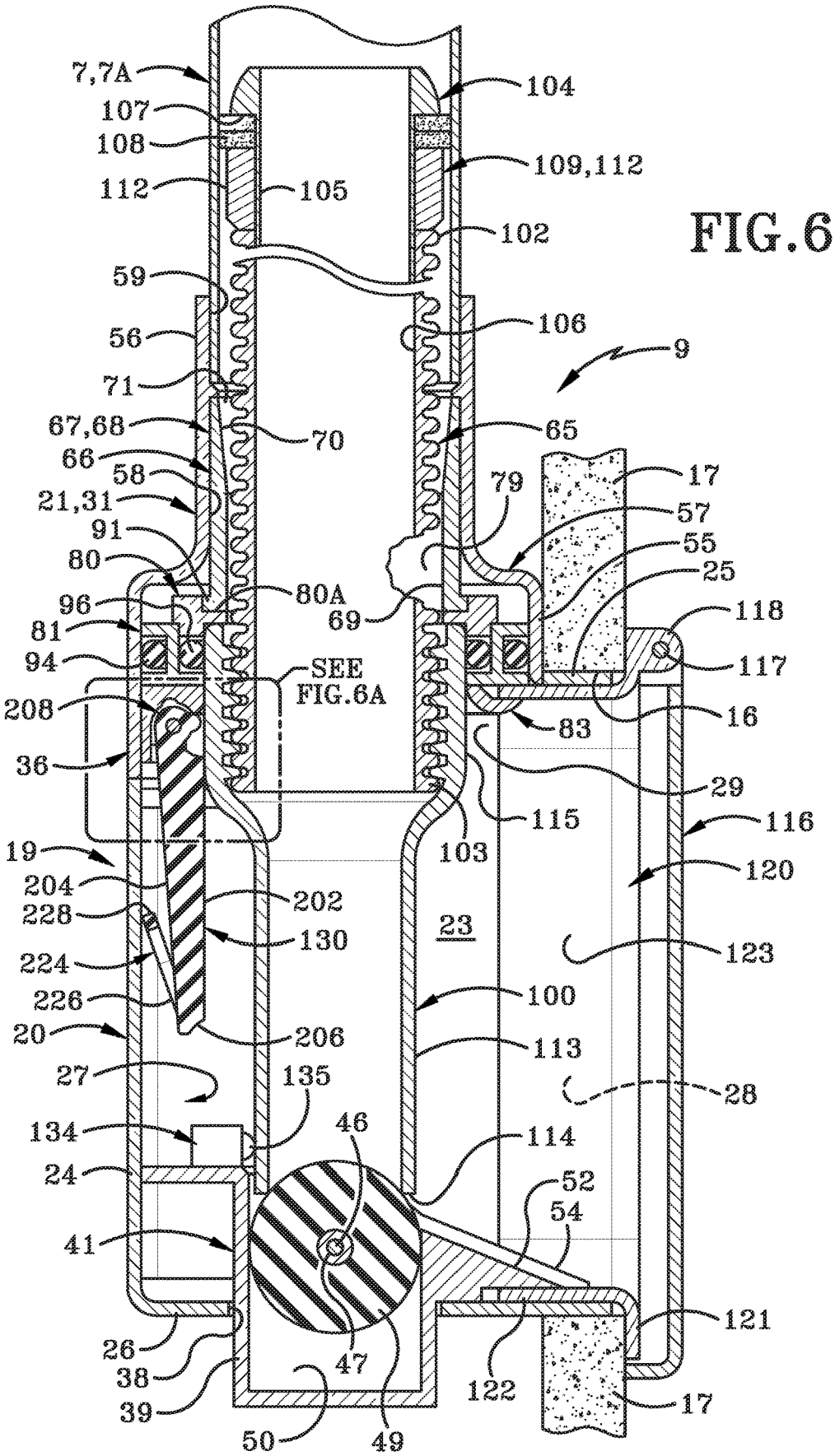
FIG. 6 is a sectional view taken on line 6-6 in FIG. 3.
Figure 7:
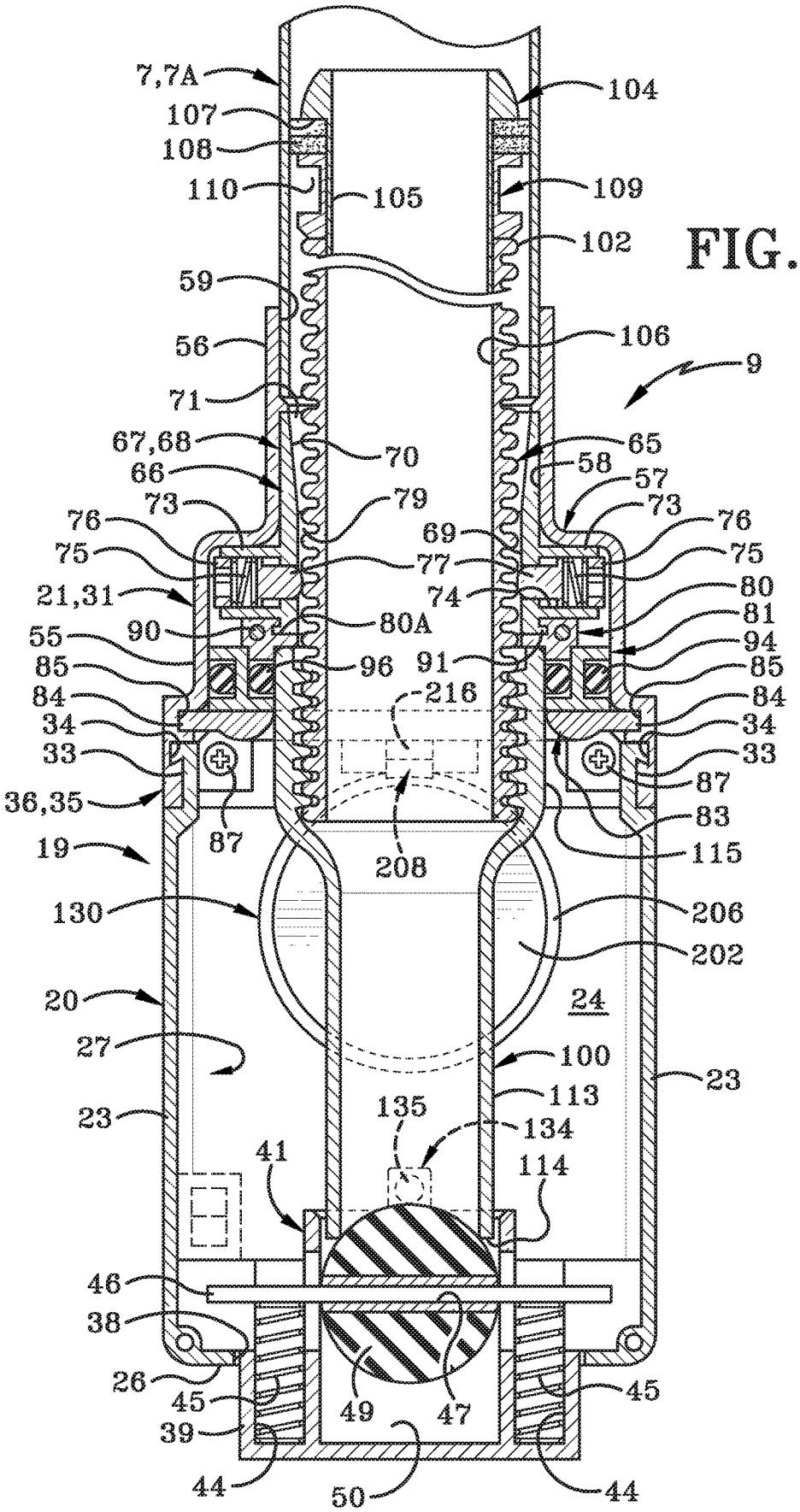
FIG. 7 is an enlarged sectional view taken on line 7-7 in FIG. 2.
Figure 8:
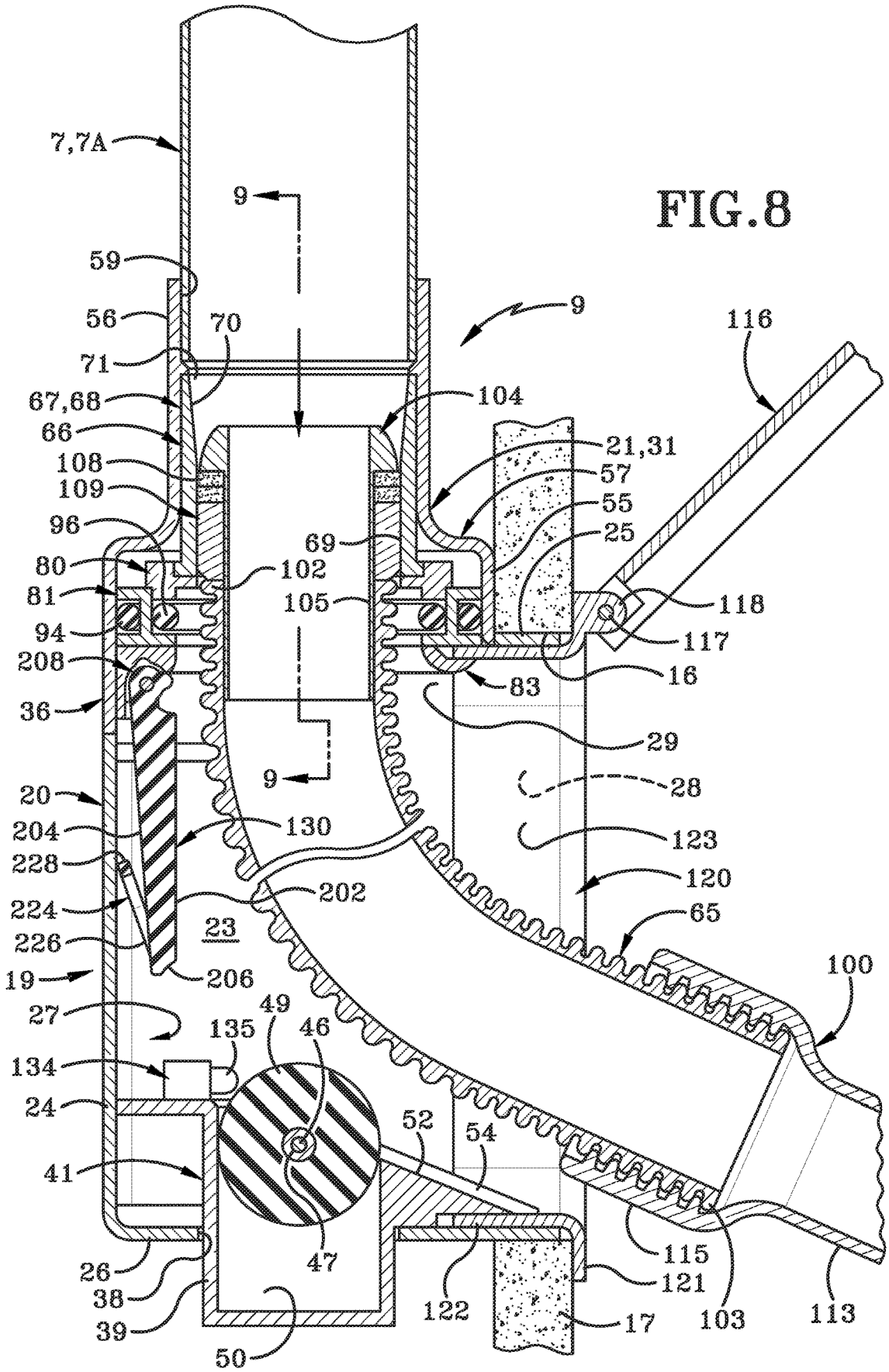
FIG. 8 is a sectional view with portions broken away showing the position of the distal end of the hose when the hose is in a fully extended position from the primary inlet valve.
Figure 9:
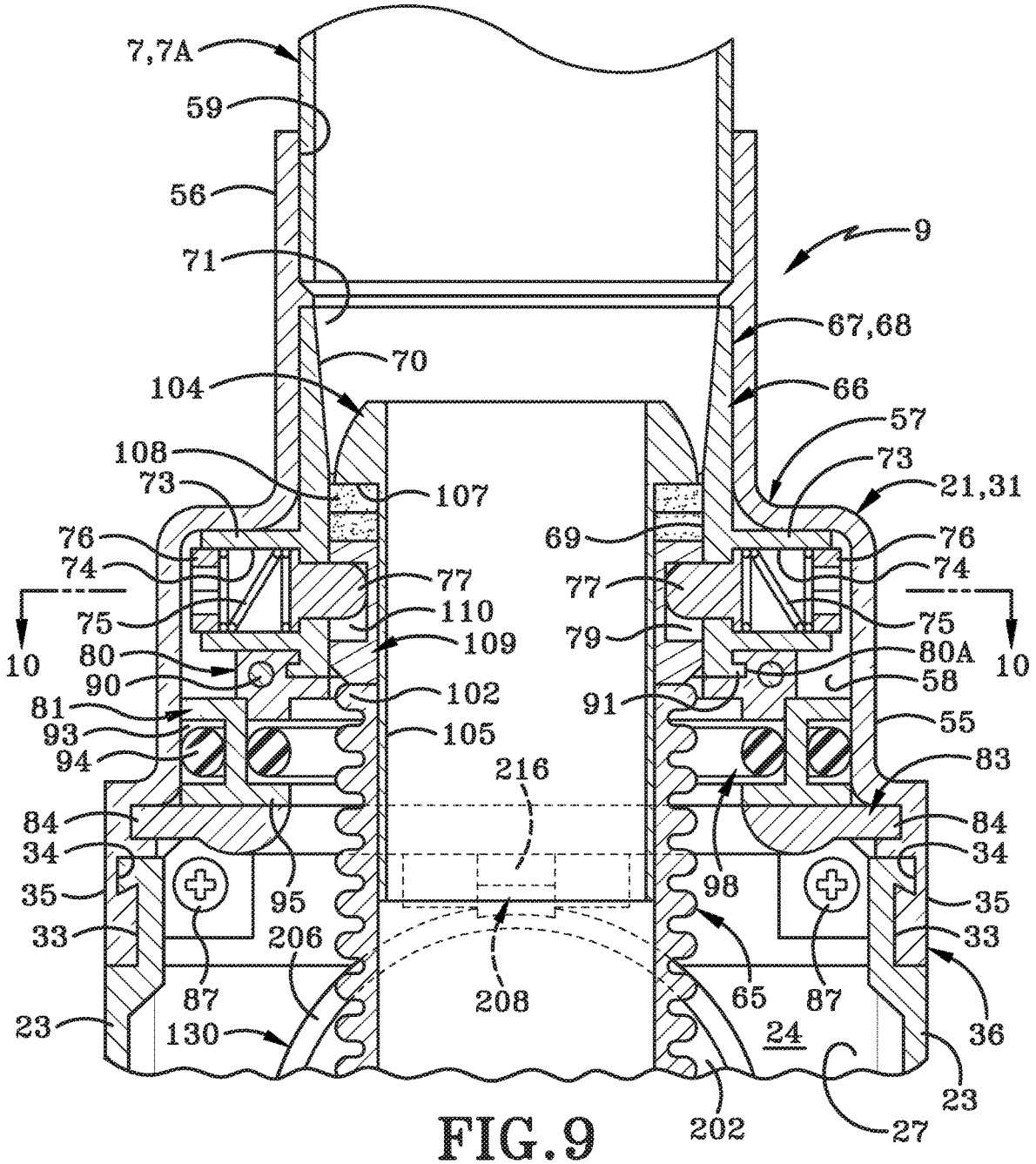
FIG. 9 is an enlarged fragmentary sectional view taken on line 9-9 in FIG. 8.
Figure 10:
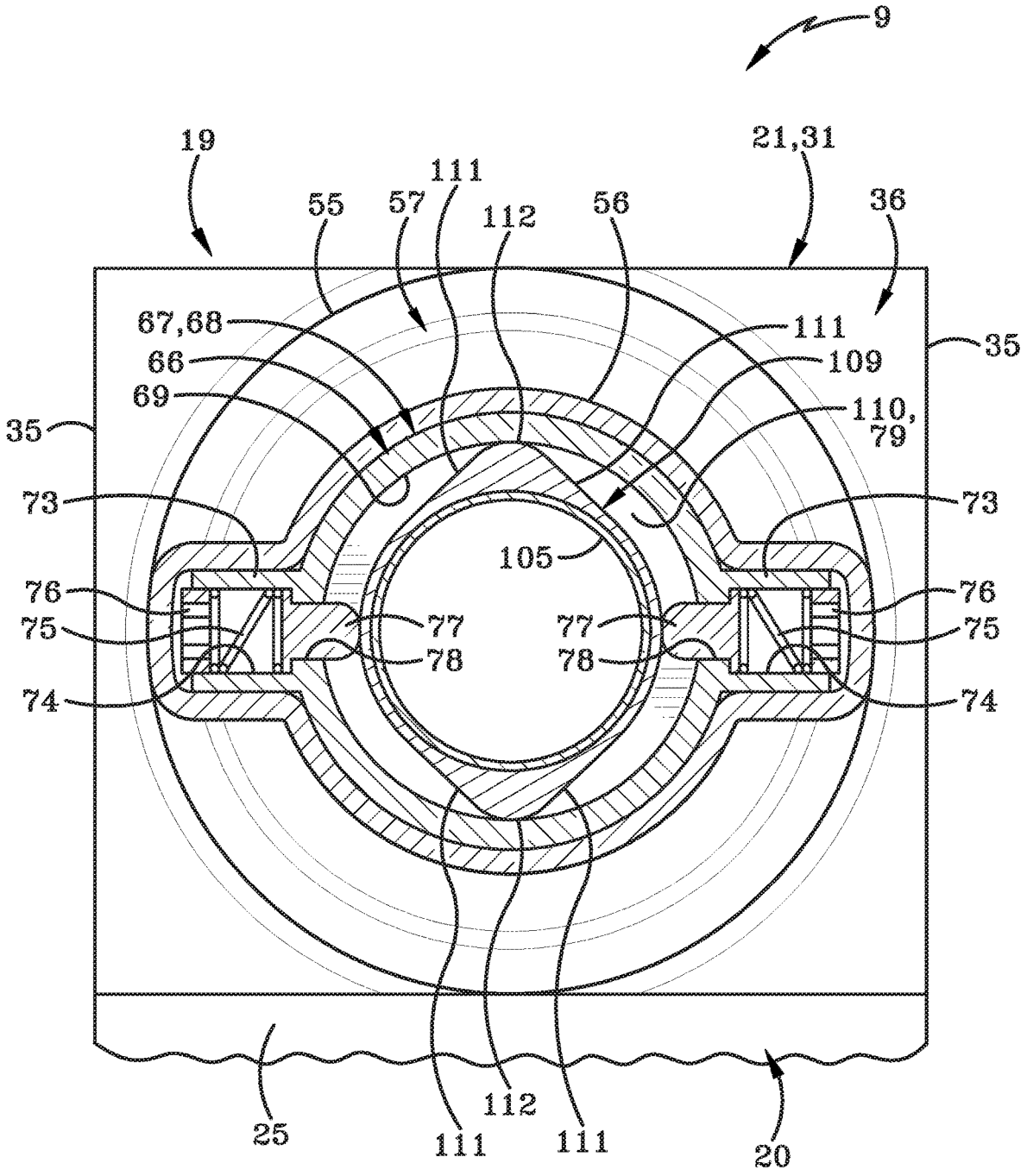
FIG. 10 is a sectional view taken on line 10-10 in FIG. 9.

Within box top 31 is a cylindrical sleeve (FIGS. 6-9) indicated generally at 66, which provides a seal when the hose reaches its fully extended position as shown in FIG. 8 and discussed further below. Sleeve 66 has a generally annular configuration formed by an annular wall 67 which has a cylindrical outer surface 68 and a cylindrical lower inner surface 69 which terminates in an outwardly tapered upper inner annular surface 70 which forms a top opening 71. A pair of diametrically opposed cylindrical lugs 73 extend outwardly from annular wall 67 (FIGS. 7, 9 and 10). Each lug 73 has a hollow bore 74 in which is contained a spring 75 retained therein by an end plug 76. Each spring 75 biases a button 77 outwardly through a hole 78 formed through wall 67 and into the hollow bore 79 of cylindrical sleeve 66. The function of buttons 77 is described further below.

Figure 4B:
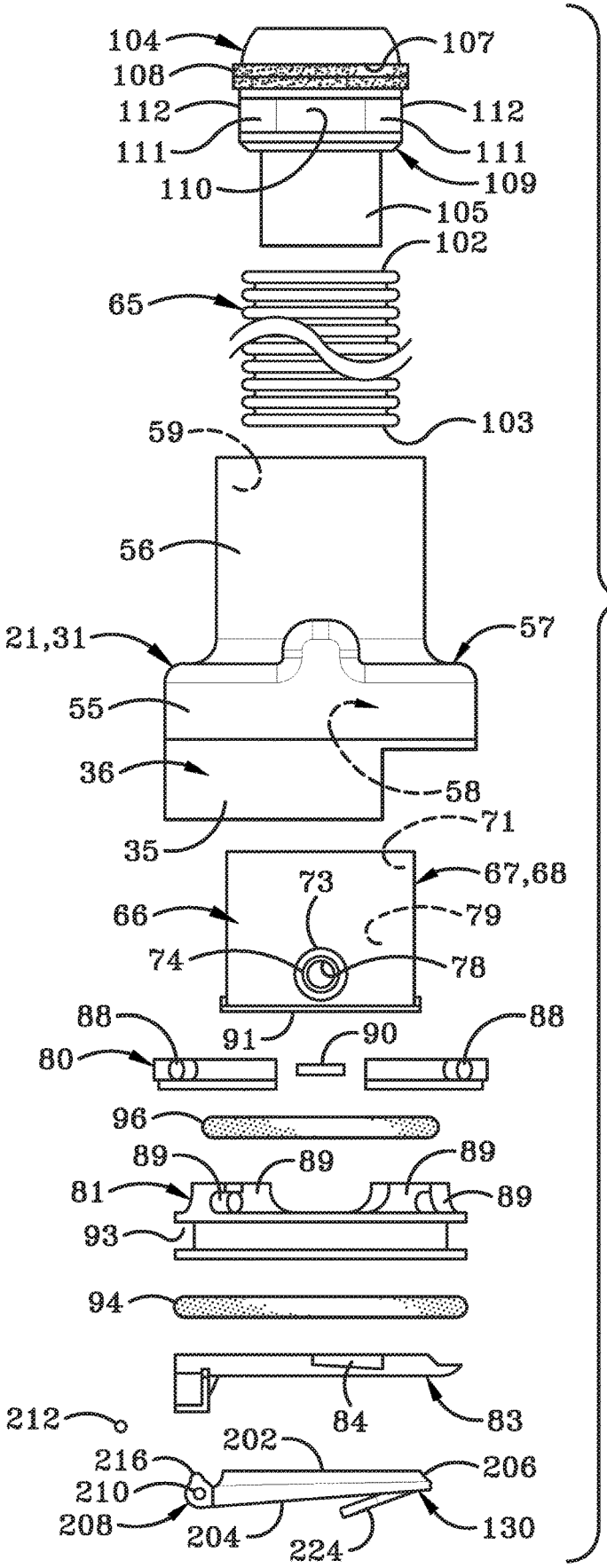
FIG. 4B is an exploded side elevational view of many of the components of the upper portion of the inlet valve of FIGS. 2 and 3.
Figure 5B:
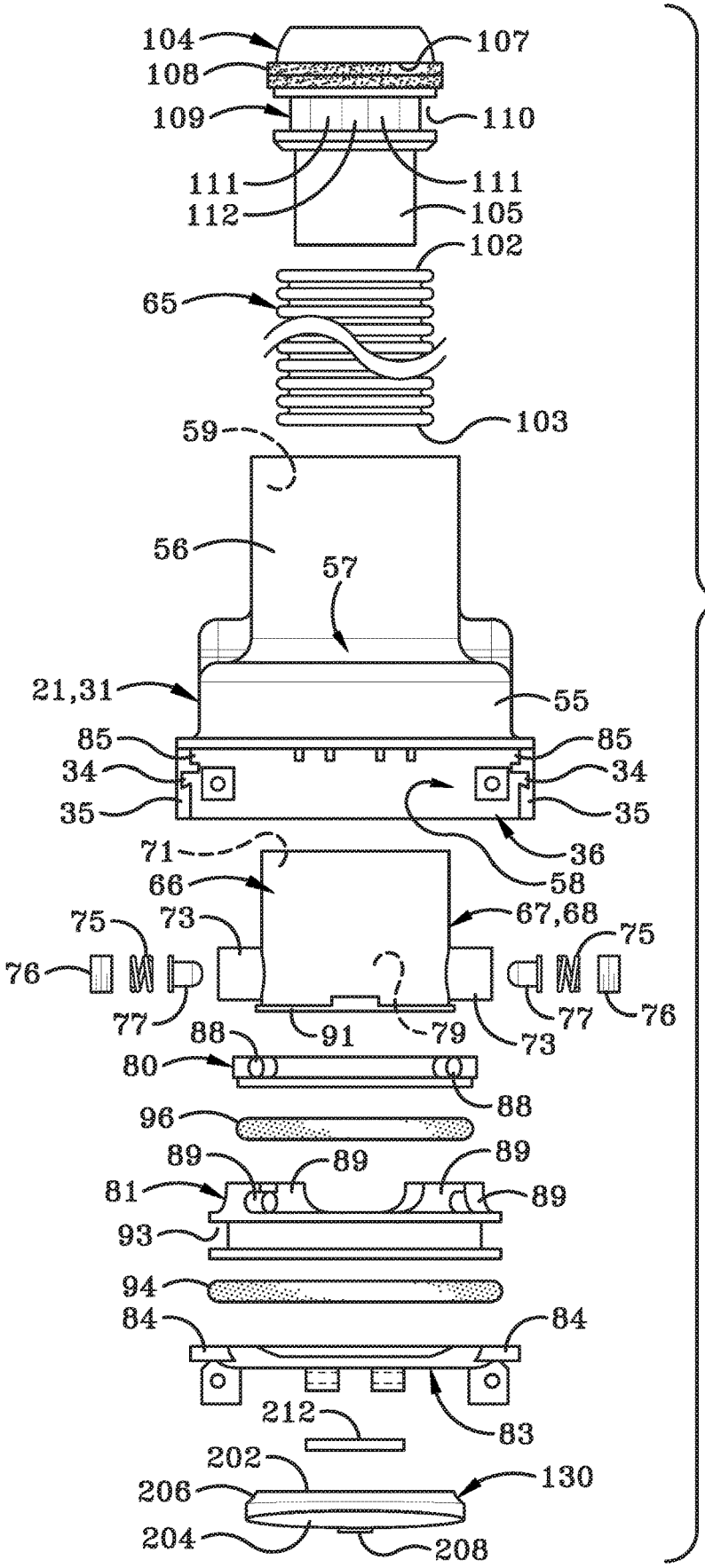
FIG. 5B is an exploded elevational view of the upper components of the primary inlet valve and distal end of the vacuum hose as shown in FIG. 4B.
Figure 5C:
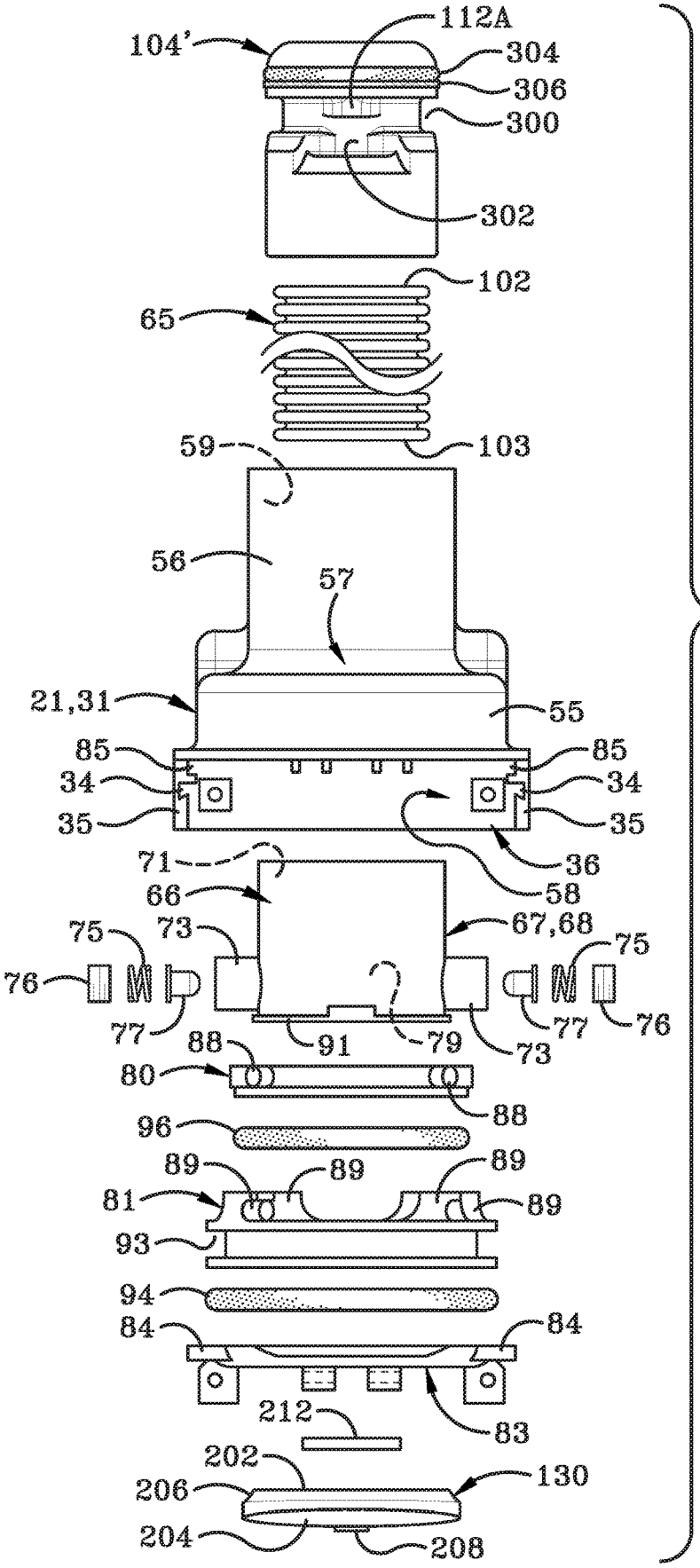
FIG. 5C is an exploded elevational view of the upper components of the primary inlet valve and distal end of the vacuum hose with the one embodiment of the hose cuff as shown in FIG. 4C.

Sleeve 66 is retained within interior 58 of box top 31 by a slip-fit engagement and by a two-piece ring indicated generally at 80 (FIGS. 4B and 5B). Ring 80 is clamped against the bottom of annular wall 67 of sleeve 66 by an annular O-ring support ring, indicated generally at 81 (FIGS. 4B and 9). Ring 81 is seated upon and secured within box top 31 by a one-piece horseshoe-shaped retaining bracket 83. Bracket 83 is secured within the bottom of box top 31 by a pair of lugs 84 which are slidably received in a pair of channels 85 formed in the lower rectangular portion of box top 31 and then by a pair of screws 87 or other type fasteners. Retaining bracket 83 can be easily removed from inlet valve 9 together with support ring 81 and split ring 80 for ease of repair should the need arise in the future.

Ring 80 includes four outwardly projecting studs 88 which are slidably received in four channel forming lugs 89 projecting upwardly from O-ring support ring 81 which assembles ring 80 and support ring 81 within the box top 31. Ring 80 has a cylindrical inner channel 80A in which is seated the bottom circular edge 91 of sleeve 66. Top opening 59 of box top 31 slidably receive an end of rigid conduit 7A therein and is secured usually by some type of an adhesive. The two semicircular pieces which form ring 80 are joined by a pair of pins 90 (FIGS. 4B and 9).

O-ring support ring 81 has an outer u-shaped channel 93 in which is secured an outer O-ring 94 and an inner annular ledge 95 on which is supported an inner O-ring 96. Inner and outer O-rings 96 and 94 of support ring 81 form an upper sealing assembly 98 for engaging a debris pickup nozzle handle indicated generally at 100, as shown in FIG. 6, the function of handle 100 is described further below.

A length of a usual type of a flexible vacuum cleaning hose 65 is slidably mounted within the interior of conduit 7A and has a distal end 102 and a nozzle end 103 on which is mounted nozzle handle 100. Referring to FIGS. 5B-9, a hose cuff indicated generally at 104, is mounted in distal end 102 of hose 65 by inserting a cylindrical tubular end section 105 into the interior bore 106 of hose 65 and secured therein by an adhesive, friction fit, threaded connection or other type of securement means. The top end of hose cuff 104 is curved downwardly and forms a bottom annular horizontally extending ledge 107 against which is seated a sealing ring 108. Sealing ring 108 is formed of a flexible material, preferably a felt-type of material, and has an annular configuration with an outer diameter just slightly smaller than the inside diameter of conduit 7A. Alternatively, sealing ring 108 may be an O-ring.

In one particular embodiment, an alternative embodiment of a hose cuff 104' is a type of hose cuff identified in a related disclosure commonly owned by the Applicant at the time of filing and is the subject of U.S. patent application Ser. No. 15/886,319 filed on Feb. 1, 2018, the entirety of which is incorporated by reference as if fully rewritten. Notably, the hose cuff in other disclosure may sometime be referred to as a hose plug, but the nomenclature is synonymous. As such, hose cuff 104' may include inter alia a hose cuff for connection with a vacuum hose conduit comprising: a first end opposite a second end defining a longitudinal direction therebetween; a longitudinal axis extending from the first end to the second end; a first cylindrical wall defining an annular channel 300 extending at least partially circumferentially around the longitudinal axis; a first cam 112A adjacent the annular channel 300 adapted to release a button 77 from a position near the cylindrical wall; a first slot 302 formed in the first cylindrical wall in communication with the annular channel, wherein the first slot is adapted to receive the button therein. This hose cuff 104' may further include wherein the first slot 302 is orthogonal to the annular channel 300. This hose cuff 104' may further include a ledge defining a portion of the first slot, wherein the ledge is longitudinally aligned with the first cam 112A. This hose cuff 104 may further include a first sloped wall orthogonal to the ledge; a second sloped wall spaced from the first sloped wall and orthogonal to the ledge; and wherein the first slot is defined between the first sloped wall and the second sloped wall. This hose cuff 104' may further include a second cylindrical wall extending towards the second end of the hose cuff from the annular channel, wherein the second cylindrical wall has a larger radius than the first cylindrical wall; wherein the first sloped wall extends between the first cylindrical wall and the second cylindrical wall; and wherein the first sloped wall extends between the first cylindrical wall and the second cylindrical wall. This hose cuff 104' may further include wherein the first sloped wall is curved and the second sloped wall is curved. This hose cuff 104' may further include wherein the first sloped wall has a flat slope and the second sloped has a flat slope. This hose cuff 104 may further include wherein a portion of the annular channel 300 that extends continuously below the first cam 112A. This hose cuff 104 may further include wherein the portion of the annular channel 300 below the first cam 112A is in open communication with the first slot 302 that is longitudinally aligned with the first cam adapted to allow the button 77 to bypass the first cam and slide down into the first slot by crossing through the portion of the annular channel below the first cam 112A. This hose cuff 104' may further include a sloped wall on the first cam extending between the cylindrical wall and an outer apex on the first cam, wherein the apex is adapted to depress the button. This hose cuff 104' may further include wherein the sloped wall on the first cam is curved. This hose cuff 104' may further include a first seal 304 extending circumferentially around the longitudinal axis exterior to the first cylindrical wall; a second seal 306 extending circumferentially around the longitudinal axis exterior to the first cylindrical wall; wherein the first seal and the second seal are offset towards the first end of the hose cuff from the annular channel.

This hose cuff 104' may further include wherein the first and second seals 304, 306 are formed from different materials. This hose cuff 104' may further include an inner diameter of the first seal greater than an inner diameter of the second seal. This hose cuff 104' may further include an outer diameter of the second seal greater than an outer diameter of the first seal. This hose cuff 104' may further include a convex outer surface on the first seal 304; and a flat outer surface on the second seal 306. This hose cuff 104' may further include wherein the first seal 304 is an elastomeric O-ring; and wherein the second seal 306 is a felt ring. This hose cuff 104' may further include an annular channel formed in the cylindrical wall extending circumferentially around the longitudinal axis; a longitudinally aligned slot formed in the cylindrical wall orthogonal to the annular channel; and wherein the first seal and the second seal are positioned towards the first end of the hose cuff from the annular channel.

Figure 11:
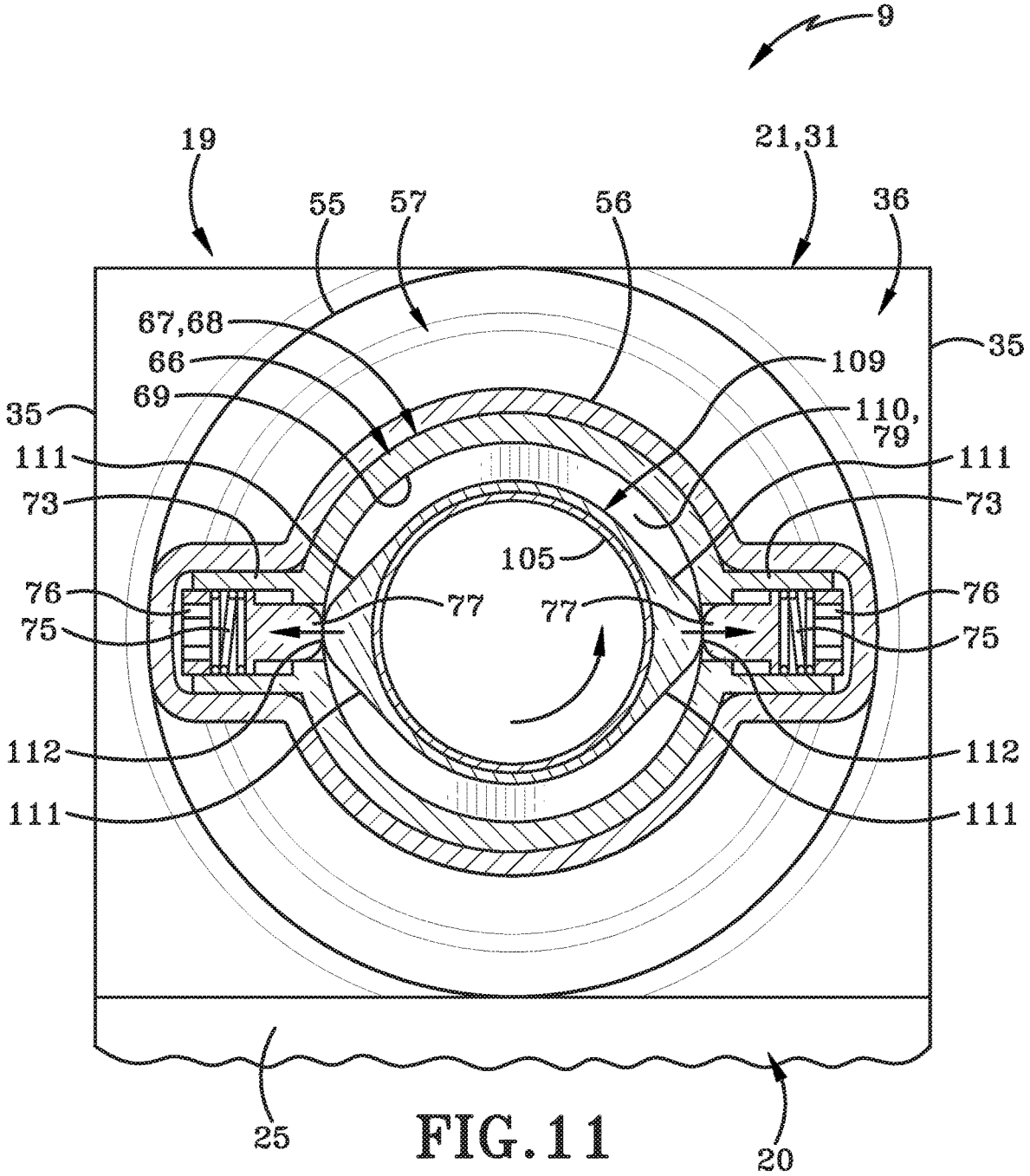
FIG. 11 is a sectional view similar to FIG. 10 with the hose end cuff rotated into an unlocked position with respect to the release mechanism.

An annular button release ring indicated generally at 109 (FIG. 56), is secured to and extends about cylindrical tubular end section 105 of cuff 104 and clamps sealing ring 108 in position against ledge 107. Release ring 109 preferably is secured on end section 105 by an adhesive or other type of attachment. Ring 109 is formed with an annular channel 110 having a pair of camming surfaces 111 which are separated by a pair of diametrically opposed vertically extending pin release cams 112 the function of which are discussed below (FIGS. 10 and 11).

Nozzle handle 100 is of a usual construction having a cylindrical elongated end 113 which terminates in a debris pickup end opening 114 (FIGS. 4A and 6). End 113 flares outwardly into a cylindrical hose attachment end 115 into which the nozzle end 103 of hose 65 is secured by an adhesive, threaded attachment or other type of securement means. End 113 may be connected to the hose 65 through a swivel attachment that enables the handle 100 to rotate relative to the hose during operation. In one particular embodiment, the swivel connection between handle 100 and hose 65 may be accomplished without the use of an O-ring between the handle 100 and the hose 65. Rather, a seal may be created based on a complementary mating fit of a flange and a recess that seals closed from vacuum suction forces originating from the source 3.

Hose 65 is of a usual construction used for central vacuum cleaning systems and has sufficient flexibility to move into and out of inlet valve 9 and around bends in the conduit when manipulated by an individual during use and which slides easily along the interior of conduit 7A, yet provides a sliding vacuum seal therebetween by sealing ring 108. Hose 65 can be the type which is non-extendable or stretchable as used in many types of vacuum cleaning systems within the concept of the present disclosure.

The other edges of housing side walls 23, of bottom wall 26, and of top wall 25 form front end opening or port 28 through which nozzle handle 100 and hose 65 extend from for performing a debris pickup cleaning operation and then retracted into the housing for subsequent storage in interior chamber 27 of housing 19. Preferably, an outer closure door 116 (FIGS. 4A and 6) is pivotally mounted at the upper end of lower portion 20 of housing 19 at the junction with box top 31 for opening and closing front end opening 28 in order to conceal interior chamber 27 of lower portion 20 and to provide an attractive faceplate for inlet valve 9 when mounted on wall stud 15 or other support structure. Door 116 is pivotably mounted with respect to housing 19 by a pivot pin 117 which extends through a flange 118 formed on and extending outwardly from a door mounting frame indicated generally at 120. Door mounting frame 120 has a rectangular outer frame 121 and a rectangular inner frame 122 which defines a rectangular opening 123. Inner frame 122 extends perpendicularly from outer flange 121.

Figure 3:
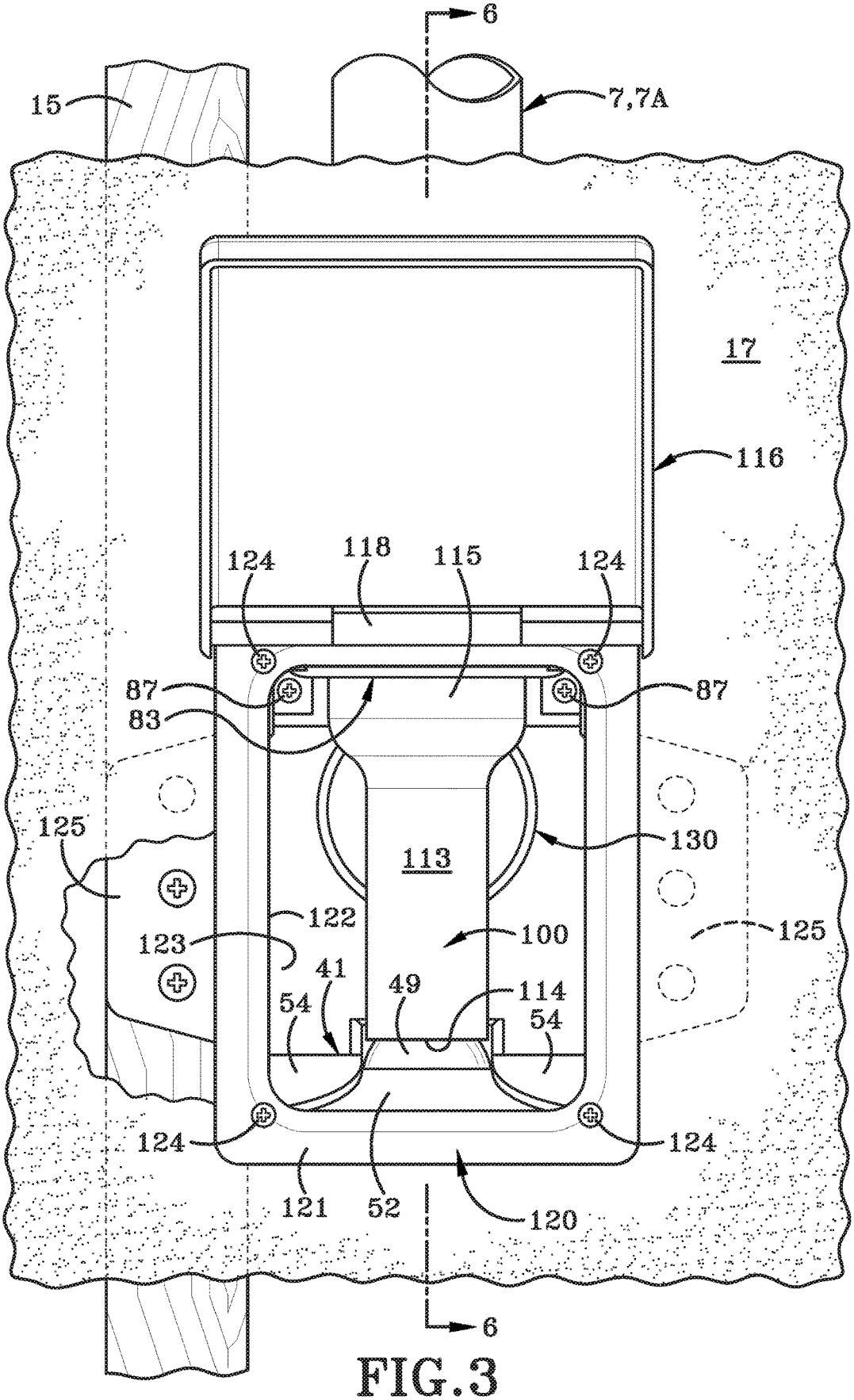
FIG. 3 is a front elevational view looking in the direction of Arrows 3-3, FIG. 2.
Figure 4C:
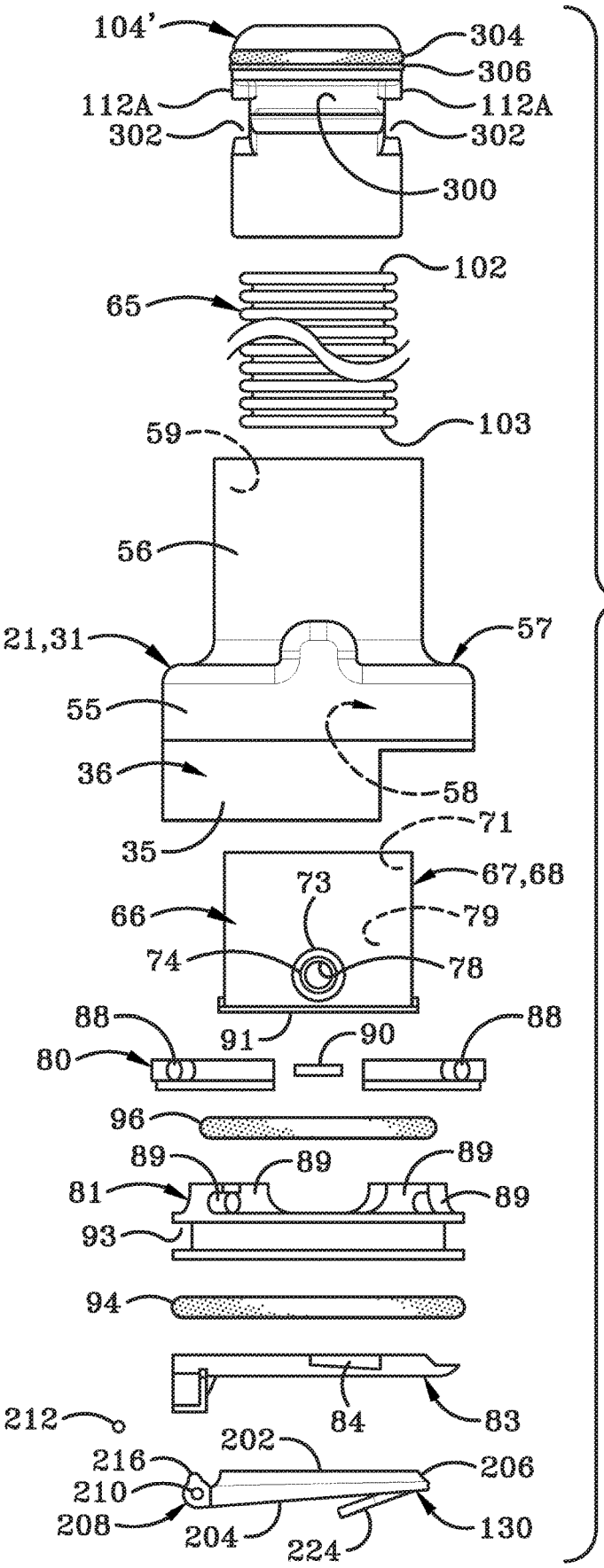
FIG. 4C is an exploded side elevational view of the many of the components of the upper portion of the inlet valve of FIGS. 2 and 3, and particularly with one embodiment of a hose cuff.

Door frame 120 is adjustably mounted on lower portion 20 of housing 19 by inner frame 122 forming a sliding friction fit with the interior surfaces of side walls 23, bottom wall 26 and top wall 25 as shown in FIG. 6 to compensate for different thicknesses of wall boards 17. The bottom member of inner frame 122 is slidably received beneath ramp 52 of bottom bracket 41 to assist in retaining door frame 120 on lower portion 20 of housing 19. Door frame 120 is secured to housing 19 by a plurality of fasteners 124 which extend through preformed holes formed in the corners of lower portion 20, as shown in FIGS. 3 and 4. Door frame 120 and door 116 are optional and the lower portion 20 is functionally operable without a door.

One or more mounting flanges 125 are formed integrally with or attached to one or both side walls 23 of lower portion 20 and extend outwardly therefrom for mounting inlet valve 9 to wall stud 15 or other support structure, which could be the aluminum or wood studs of a building, a concrete wall or other type of material from which the structure is formed. Door 116, door frame 120, mounting flanges 125 and housing 19 can be formed of various materials such as of a rigid molded plastic or various other types of metal materials without affecting the concept of the invention.

Figure 12:
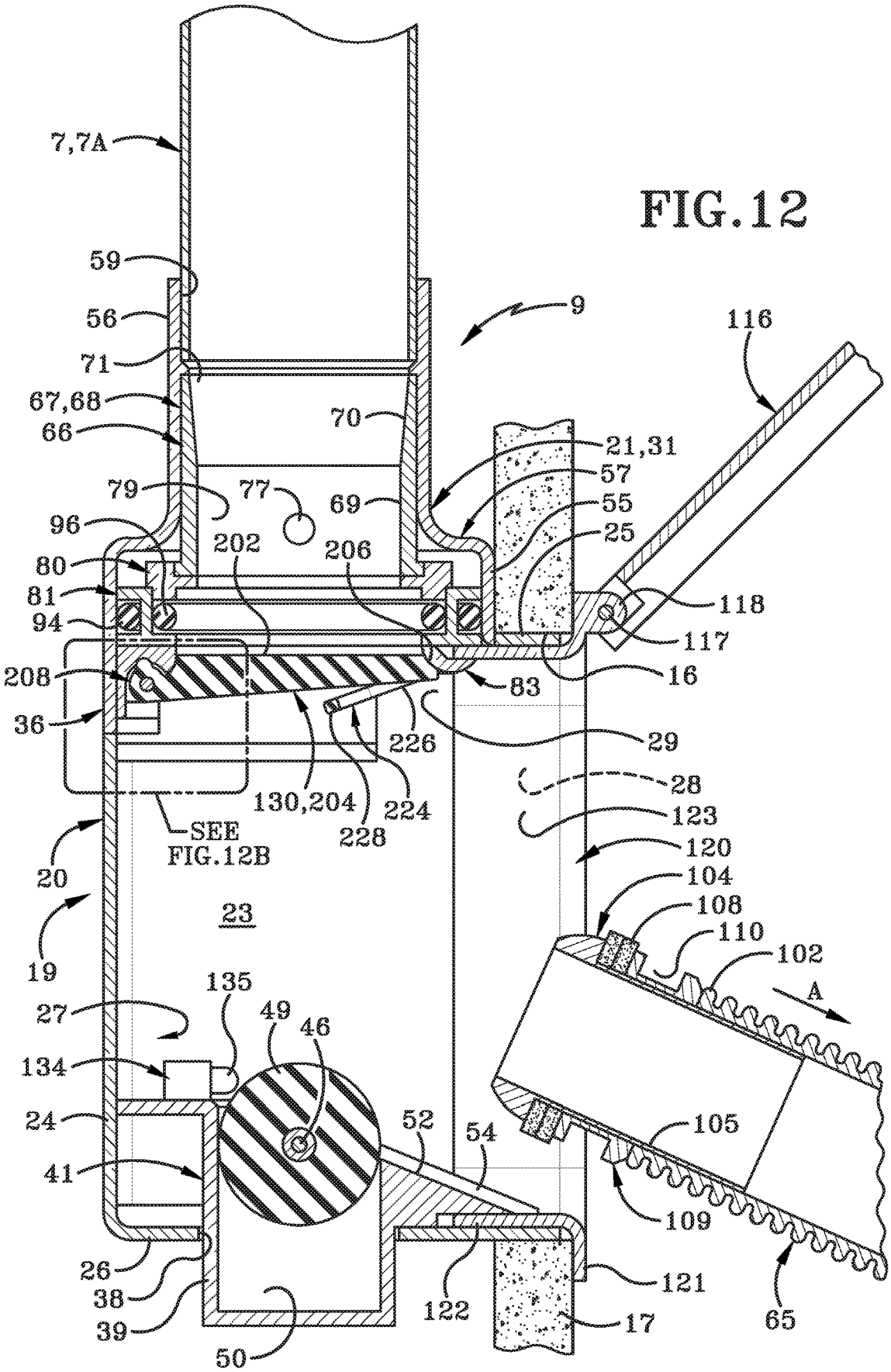
FIG. 12 is a sectional view similar to FIG. 8 after the distal end of the hose has been removed from the primary inlet valve and the internal sealing door in a closed sealed position.

A vacuum closure flap 130 is pivotally mounted within lower portion 20 of housing 19 by a pivot pin 131 and can, according to one embodiment, be biased by a spring (not shown) toward a closed position in sealing engagement with the open end of conduit 7A as shown in FIG. 12 to seal the open end of the conduit when hose 65 is completely removed from the inlet valve. However, as shown by the embodiments provided herein, a spring is not required to bias the flap 130 closed, but rather the material forming the flap can be resilient to bias itself between open and closed positions. Closure flap 130 can be mounted by various means within housing 19 and can engage sealing O-ring 96 as shown in FIG. 12 or directly against the bottom of cylindrical sleeve 66 without affecting the concept of the present disclosure so long as it seals the open end of the conduit when hose 65 is removed from the housing.

Flap 130 may be a unibody that is integrally extruded, molded, printed, additively fabricated or formed as a unitary, monolithic member substantially fabricated from an elastomeric, flexible, or at least semi-flexible, manmade or natural, material. In one example, polymers or rubber (natural or synthetic), may form a substantial majority of the components or elements used to fabricate the flap 130 and the various components integrally formed, molded, or extruded therewith. The flap 130 should withstand typical central vacuum operation and handling from an operator inserting and removing the hose 65 into conduit 7 in system 1. While it is contemplated that the flap 130 and its additional components described herein are uniformly and integrally extruded, molded, or formed, it is entirely possible that the components of the tool body be formed separately from alternative materials as one having routine skill in the art would understand. Furthermore, while the components of the flap 130 are discussed below individually, it is to be clearly understood that the components and their corresponding reference elements of the flap 130 are portions, regions, or surfaces of the flap 130 and all form a respective element or component of the unitary flap 130. Thus, while the components may be discussed individually and identified relative to other elements or components of the flap 130, in this exemplary embodiment, there is a single flap 130 having the below described portions, regions, or surfaces.

Closure flap 130 is a generally disc-shaped or plinth-shaped member defining an outer circumferential edge that is moveable between an open first position (FIG. 6) and a closed second position (FIG. 12). Closure flap 130 includes a first major surface 202 opposite a second major surface 204. A tapered annular edge 206 defines a minor surface and extends in a tapered manner from the second surface 204 to the first surface 202. Edge 206 substantially defines an outer circumference of the flap 130 that tapers and an angle relative to the longitudinal axis to allow edge 206 to fit at least partially within an end of the conduit or other portion of the housing to seal the same. Accordingly, first surface 202 has a smaller diameter than the second surface 204. However, both surfaces 202, 204 are considered to be major surfaces of the flap 130 relative to the edge 206 that defines a minor surface. An extension arm or boss 208 extends from annular edge 206 and defines an aperture 210 receiving a pin 212 therethrough that defines a pivot axis 214 about which the closure flap 130 rotates. Pivot axis 214 is offset perpendicular to a longitudinal center axis of the valve 9, and in one particular embodiment, axis 214 is offset perpendicular on an opposite side of longitudinal center axis of the valve 9 than the opening 28 to the valve. Pin 212 is connected, at least indirectly, with lower portion 20 of valve 9. In one particular embodiment, pin 212 is offset generally parallel to rear wall 24 and generally aligned orthogonally with the sidewalls of the lower portion 20.

The boss 208 includes two sidewalls that are parallel to each other and generally perpendicular to the first and second surfaces 202, 204, respectively. Thus, the boss 208 may generally be considered to be orthogonal or perpendicular to the major surface area of the flap 130. A short sidewall extends transversely between the two sidewalls of the boss to define a convexly curved outer surface 220. A protrusion or projection 216 extends radially outward from the boss 208 relative to the pivot axis 214. While the protrusion 216 is being described as a different component, it is to be understood that it is formed integrally with the boss 208 as indicated in the cross-section of FIG. 6A. Boss 208 and protrusion 216 collectively define the convexly curved outer surface 218 that is shaped complementarily to a concavely curved surface 220 of a receiving area within the lower portion 20 of the inlet 9. However, the convexity of the protrusion 216 has a smaller radius of curvature than the convexity of the short sidewall defining the primary portion of surface 220. Concave surface 220 defines a concave recess 222 having a smaller radius of curvature than that of concave surface 220. The radius of curvature of the protrusion 216 complements the radius of curvature of the recess 222. As will be described in greater detail below, when the closure flap 130 is in the closed second position, the protrusion 216 fits within or nests with the concave recess 222.

With continued reference to FIG. 6, closure flap 130 includes a small handle or pull tab 224 extending outward from second surface 204. Pull tab 224 includes a first end 226 connected with the second surface 204 and a terminal free end 228. Thus, tab 224 may be considered a cantilevered element relative to the second surface 204 of the flap 130. The first end 226 is connected with the second surface 204 adjacent its radial outermost or circumferential edge. Stated otherwise, the pull tab 224 is oriented in a manner such that the connected first end 226 is positioned radially outward from the center of the closure flap 130 than the terminal free end 228. Terminal free end 228 is spaced slightly above or apart from the second surface 204. When the closure flap 130 is in the open first position (FIG. 6), pull tab 224, namely the terminal free end 228, is positioned closely adjacent the rear wall 24 and may come directly in contact therewith. The positioning of the pull tab 224 in contact with rear wall 24 may preclude the second surface 204 from coming in direct contact with the rear wall 24 such that the second surface 204 is spaced apart generally parallel, but may be with a slight angle, relative to the inner surface of rear wall 24.

Figure 6A:
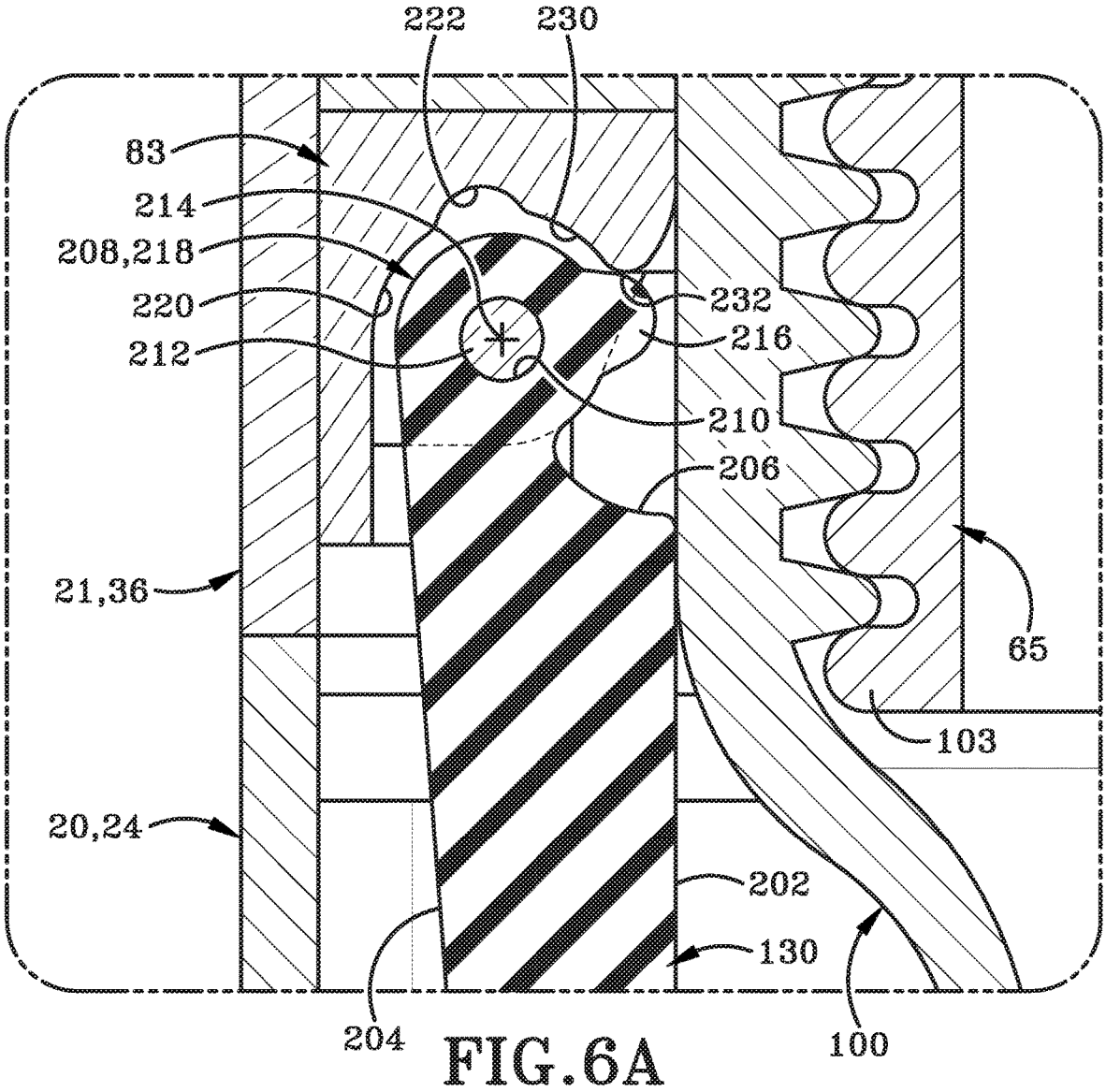
FIG. 6A is an enlarged section view of the region labeled "SEE FIG. 6A" in FIG. 6.

First surface 202 may be substantially parallel and coplanar in the open first position with a portion of the handle 100. Second surface 204, in the same open first position, may be slightly angled relative to the first surface 202. The slight tapering from the upper portion adjacent pin 212 tapers downwardly at an angle towards the lower portion of the closure flap 130 where the pull tab 224 is connected at its first end 226. Thus, the closure flap 130, when viewed in cross-section as shown in FIG. 6, is thicker adjacent its upper end than its lower end. Note, the upper end refers to when the closure flap 130 is oriented in the open first position such that the boss 208 is associated with a higher vertical height than the pull tab 224. When the closure flap 130 is in the open first position, as shown in FIG. 6A, the protrusion 216 extends laterally towards the front of the lower portion 20 (towards the right in FIG. 6A). The protrusion 216 is positioned lower than a concave frontal surface 230 that is located on the opposite side of the recessed 220 from concave surface 220. Concave frontal surface 230 terminates at convex end 232 and the protrusion 216 is below the convex end 232. Further, the protrusion 216 extends radially outward relative to pivot axis 214 farther than the convex end 232 to releasably lock the closure flap 130 in the open first position. As will be described in greater detail below, the closure flap 130 may be closed to the closed second position by overcoming a force to decrease the radially height of the protrusion 216 such that it passes the convex surface 232 to ride or move along the concave surface 230 and fit within the recess 222 to effectively releasably lock the closure flap 130 in the closed second position.

Pivot pin 212 may be positioned lower than the upper portion 221 of the box top. More particularly, pivot pin 212 is positioned lower than the upper portion 21 such that it may cover and seal the lower end of conduit 7A when the hose 65 is removed and the closure flap 130 is moved to the closed second position. Further, pivot pin 212 is positioned above the lower wall 26 of the housing. Flap 130 is positioned, when viewed in cross section as shown in FIG. 6, rearward from the rectangular opening 123, rearward from the drywall 17, and rearward from sealing ball 49. Closure flap 130 is oriented in a manner such that the open position of the closure flap 130 is associated with being generally upright and vertical and parallel to the back wall of the housing/assembly when the closure flap 130 is opened. Then, to close the closure flap 130, it is moved about the pivot axis 214 such that the surfaces 202 and 204 are generally offset parallel to the ground surface and perpendicular to the wall or substrate to which the primary valve 9 is mounted. The pivot axis 214 defined by pin 212 is located vertically above the lower edge defining opening 28. This is in contradistinction from other vacuum closure seals or flaps that are connected with outer covers that closed and generally parallel to a wall (i.e., drywall 17) and open in an orthogonal relationship relative to the wall about and that pivot about a pin or hinge below the outlet. The reason that the closure flap 130 of the present disclosure works distinctly opposite that of conventional closure flaps is that the closure flap 130 is positioned within the valve assembly 9 rather than being attached to the outside cover door as typically seen on closure flaps, which allows the housing to be open to the atmosphere and not need to be a closed system. Furthermore, the neutral position or home position is considered the open position for the closure flap 130 of the present disclosure. This is also a distinction which with conventional valve assembly closure flaps that are typically biased closed and are only opened when they need to be used. Because of the seals operating on the hose cuff 104, the closure flap 130 may be biased open in its home position and only be closed when the vacuum hose 65 is removed from conduit 7 and transported and connected with secondary valve 11.

An electrical switch 134 is mounted within lower portion 20 of housing 19 so that it engages nozzle handle 100 when the handle is in its stored position as shown in FIGS. 6 and 7 to turn off vacuum source 3, and which will turn vacuum source 3 on when the handle has been removed for a cleaning operation as shown in FIGS. 8 and 12. Switch 134 can be of a type which has an actuation button 135 that is spring biased into an outward ON position as shown in FIGS. 8 and 12 or could be a type of toggle switch without affecting the concept of the invention. In one particular embodiment, the switch may be electrically connected to the sealing ball 49 such that when the handle 100 is removed from its connection with ball 49, the switch automatically turns on the vacuum source 3 to initiate suction through the hose 65. Stated otherwise, the system 1 is a single action system that enable the automatic initiation of vacuum suction forces in response the handle being disconnected from the sealed connection with ball 49. Further, when the cleaning action is finished, the handle 100 may be reconnected with sealing ball 49 and this connection immediately and in real time signals the vacuum source to stop providing suction force through the hose 65. Thus, the single action vacuum system operates to turn-on and turn-off the source in response to the switch's signal that is triggered by the sealing ball 49. In accordance with another aspect of the single action system 1, the hose handle itself may be utilized to actuate the switch while removing the handle from its home position to turn the switch on and inserting the hose into its retracted position to turn the hose off. Thus, the single action system may be effectuated through a mechanical or physical connection between the surface of the switch and the outer surface of the hose handle. Similarly, a spring button switch may be utilized that biases the switch to an off position, when the handle of the hose 65 is stored and sealed via ball seal 49. When the hose handle is removed from the ball 49, the spring of the spring bias switch initiates the switch to turn on. Thus, the automatic on/off control of the vacuum suction moving through the hose 65 is operated in response to the handle being removed the sealing ball 49.

When an individual desires to perform a cleaning operation, the individual merely grasps nozzle handle 100 and pulls outwardly, which will automatically cause ball 49 to be depressed downwardly within central channel 50. Continuing to pull outwardly on nozzle handle 100 will slide the hose along the interior of conduit 7A until a desired length is pulled from the inlet valve for use in a debris pickup cleaning operation. Hose cuff 104, and in particular sealing ring 108, will provide a sliding seal within the interior of conduit 7A throughout its length of travel therein. This provides a sufficient seal so that most of the vacuum within conduit 7A is applied to end opening 114 of nozzle handle 100. Primary inlet valve 9 is similar in many respects as to the inlet valve shown and described U.S. patent application Ser. No. 15/675,228, filed Aug. 11, 2017, the contents of which are incorporated herein by reference.

When nozzle handle 100 is in a retracted stored position (FIGS. 6 and 7), ball 49 is biased upwardly by coil springs 45 into sealing engagement with end opening 114 of the nozzle handle. This seals the vacuum created within hose 65 by vacuum source 3 from the surrounding atmosphere. Also, when nozzle handle 100 is in this retracted stored position, upper sealing assembly 98 and in particular inner and outer O-rings 96 and 94 will seal the vacuum created within conduit 7A from the ambient atmosphere and interior of housing 19 (FIG. 6A). Thus, both the vacuum created within the hose and that created within the connecting conduit is completely sealed within housing 19. This avoids the necessity of providing an airtight box as required by other inlet valves for central vacuum cleaning systems.

Figure 12A:
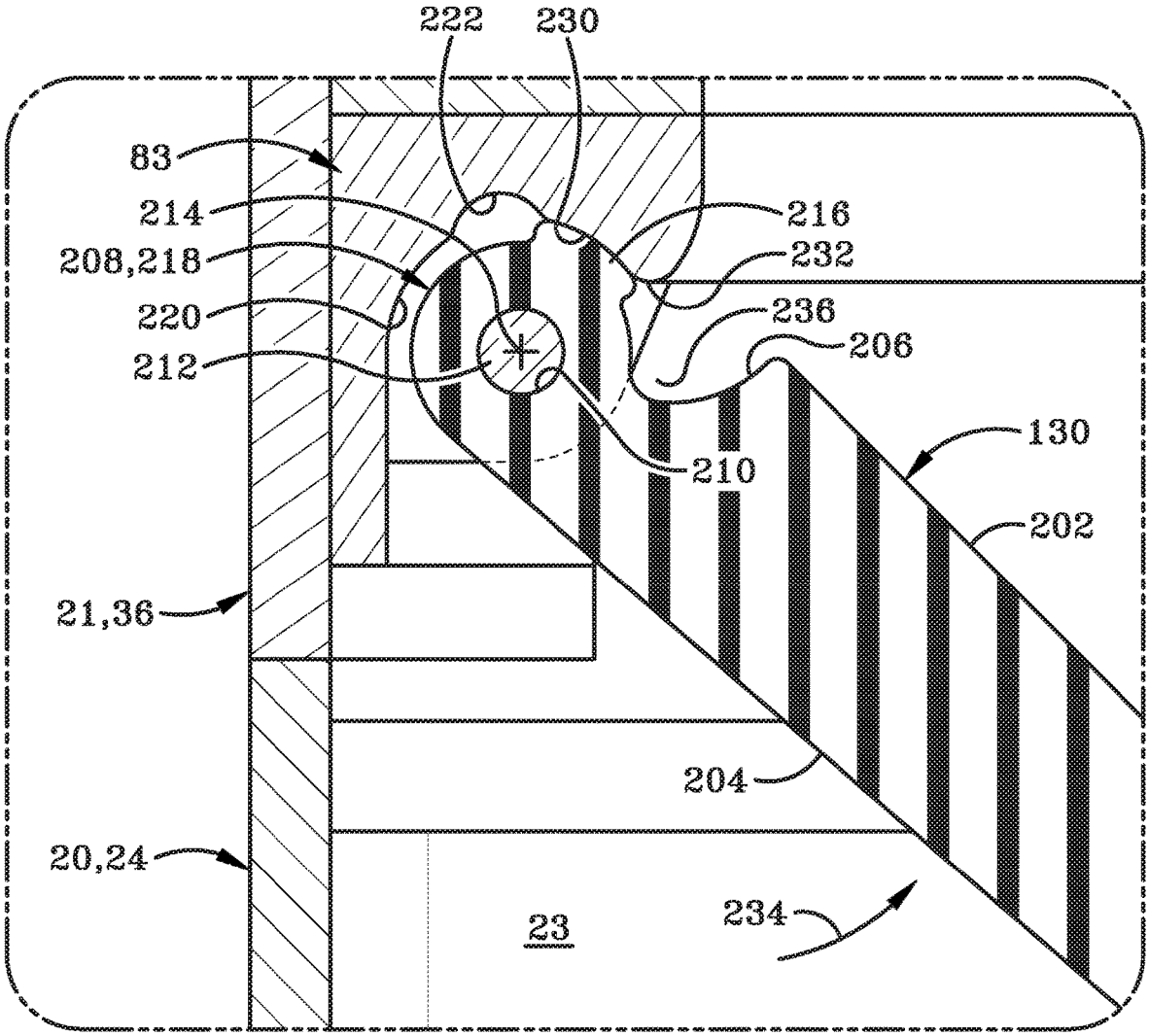
FIG. 12A is an enlarged section view of a closure flap approximately half way between an open position and a closed position and depicted a protrusion on the closure flap being compressed during the movement between the open and closed position.
Figure 12B:
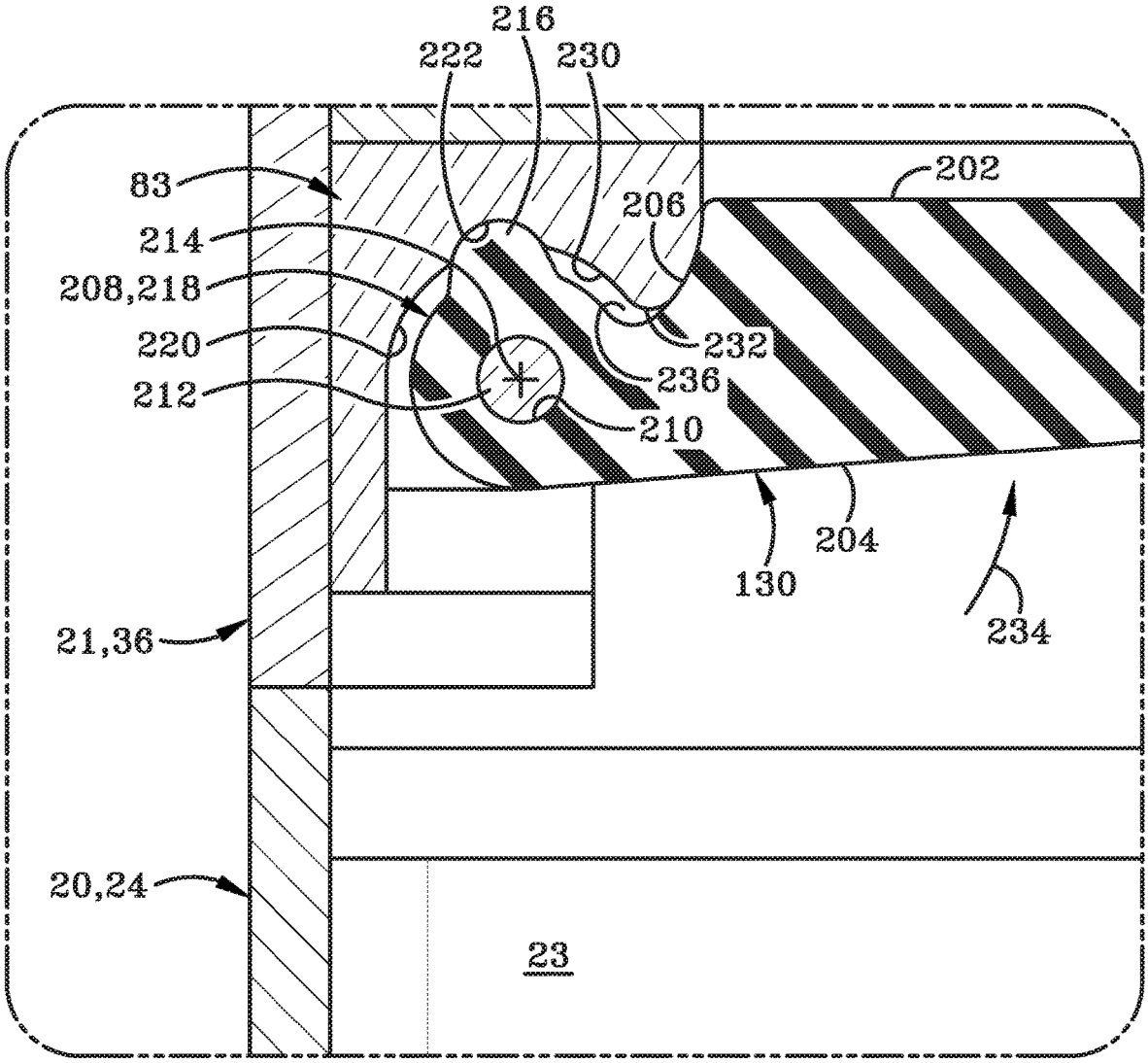
FIG. 12B is an enlarged section view of the region labeled "SEE FIG. 12B" in FIG. 12 depicting the closure flap in the closed position.

In operation and with reference to FIG. 12, FIG. 12A, and FIG. 12B, after the hose 65 is removed in the direction of arrow A by disconnecting the hose cuff 104 from the pins 77 or buttons 77, the closure flap 130 may be lifted and pivoted so as to rotate about the pivot axis 214 from the opened first position towards the closed second position. As depicted in FIG. 12A, when the closure flap 130 is pivoted about axis 214 in the direction of arrow 234, the protrusion 216 squishes, compresses, or is otherwise smooshed to reduce its dimension. This is caused in part due to the convex end 232 that depresses the protrusion 216. The protrusion 216 remains in a depressed, compressed, or smooshed state as the protrusion rides along the concave surface 230 as the closure flap 130 is rotated about axis 214 in the direction of arrow 234. As depicted in FIG. 12B, closure flap 130 continues to rotate about axis 214 in the direction of arrow 234 until the protrusion 216 fits within the recess 222. The elastomeric formation of flap 130 enables a resilient formation of the protrusion 216 that enables it to reconstitute its original shape so as to expand and fit within the recess 222 so as to prevent the closure flap 130 from moving from the closed second position. Stated otherwise, the weight of the closure flap 130 is insufficient to overcome the rigidity imparted by the protrusion 216 when nestled or mattingly fitted within the recess 222. However, this locking relationship may be overcome through a downwardly applied force by an operator to open the closure flap 130 from the closed position and move the closure flap 130 towards the open position. Stated otherwise, the weight of the closure flap 130 is insufficient to compress the protrusion 216 so as to open the closure flap 130. However, physical manipulation or force by a user is able to impart sufficient force to compress the protrusion 216 and open the closure flap 130 while pivoting the closure flap 130 about the axis 214. Thus, the closure flap 130 is considered a releasable locking flap, but the locking forces to overcome the flap in each position are determined by the resiliency of the material from which the closure flap 130 is made. In some particular embodiments, the closure flap 130 is made from elastomeric or other polymer material that provides a good seal of the end vacuum conduit 7A.

As depicted in FIG. 12B, when the closure flap 130 is in the closed second position, the convex end 232 of the wall 230 fits within the region 236 defined between the tapered edge 206 and the boss 208. The seal is then completed by the convex surface 232 mating with the tapered annular edge 206 in a full 360° circumferential seal to completely seal the end of conduit 7A or the cylindrical collar (or another part of the housing) after hose 65 has been removed as depicted in FIG. 12. Then the hose 65, as described in other parts herein, may be connected with a secondary valve 11 to perform a vacuuming function in another room of the structure.

In order to reinsert the hose 65 into conduit 7, an operator may pull the pull tab 224 downwardly with sufficient force so as to release the closure flap 130 from its releasably locked closed position. As stated previously, pulling the tab 224 with sufficient downward force compresses the protrusion 216 which enables it to ride along the concave surface 230 and pass over the convex end 232 where the resilient protrusion 216 reforms or reconstitutes it original shape so as to extend past the convex surface 232 to releasably lock the closure flap 130 in the open first position.

Figure 13:
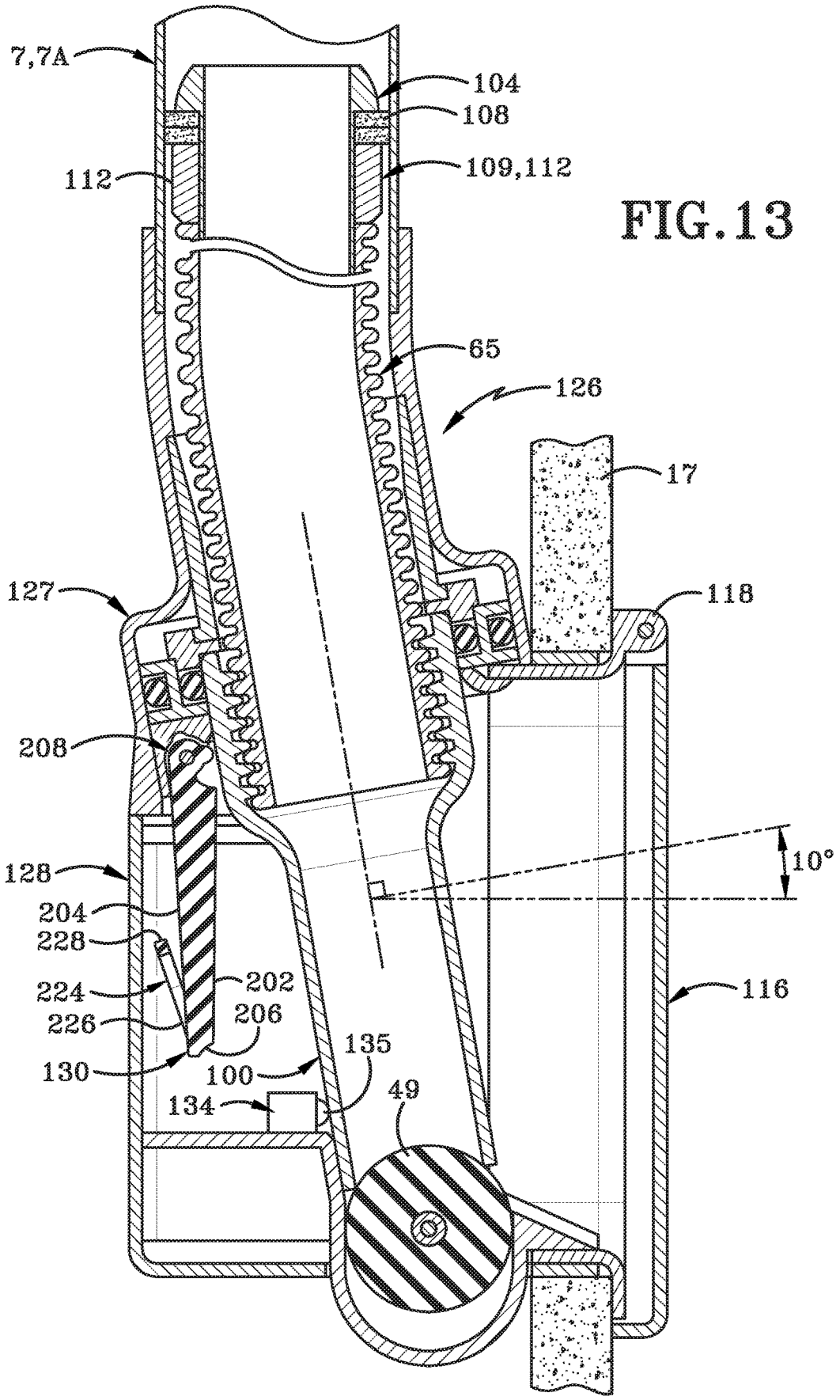
FIG. 13 is a view similar to FIG. 6 of a slightly modified primary inlet valve in which the top portion is at an angle with respect to the bottom portion of the valve box.

A modified embodiment of primary inlet valve 9 is shown in FIG. 13 and is indicated generally at 126. Inlet valve 126 is nearly identical to that of inlet valve 9 discussed above, with the main difference being that a top box 127, which is nearly identical to box top 31, is at an angle of approximately 10 degrees with respect to a lower rectangular portion 128 which again is similar or nearly identical to lower portion 20 of inlet valve 9. This angular relationship facilitates the outward pulling movement on nozzle handle 100 making it easier to remove the nozzle handle from within the inlet valve and/or replacing the same therein. It also reduces the amount of force needed for nozzle handle end to depress ball 49. The other components of this embodiment are similar or the same as that described above with respect to inlet valve 9 and thus are not described in further detail.

In accordance with one of the features of the disclosure, one or more secondary inlet valves 11 are spaced throughout the structure and connect to central vacuum source 3 by a plurality of conduits 7B as shown in FIG. 1. As discussed above, removing hose 65 from within primary inlet valve 9 by rotating hose cuff 104 until buttons 77 align with cams 112 as shown in FIG. 11, closure flap 130 will seal the end of the conduit 7A. As shown in FIG. 12, the user will merely take hose 65 to the next desired cleaning location adjacent a secondary inlet valve 11. The user merely inserts hose cuff 104 into the selected secondary inlet valve 11 to snap into locking engagement within an annular channel to secure the hose end therein. The opening movement of closure door will automatically actuate a switch to turn on central vacuum source 3 supplying the desired debris pickup suction to nozzle pickup handle 100. After a cleaning operation has been completed, the user merely rotates hose cuff until buttons or pins align with cams 112 enabling the hose to be removed therefrom, afterwhich closure door will move to a closed position and engage switch to turn off vacuum source 3.

Hose 65 then can be moved to another secondary inlet valve 11 to clean another area if desired or reinserted into conduit 7A through primary inlet valve 9 until the hose is completely in a stored position as shown in FIGS. 6 and 7. This system and method of operation enables a dwelling to have a single primary inlet valve 9 and a plurality of secondary inlet valves 11 requiring the use of only a single length of hose 65 which can be moved easily between the desired secondary inlet valves and then returned to permanent storage within conduit 7A connected to primary inlet valve 9. This avoids the use of multiple hose sections and the storage thereof in various closets or other areas requiring the use of additional space by the occupant. Furthermore, secondary valves are of a simple construction and less expensive than a plurality of primary inlet valves, reducing the overall cost of the vacuum cleaning system to the homeowner. Furthermore, an upper floor as shown in the dwelling of FIG. 1 need not have a primary inlet valve 9 installed therein as shown but can only have multiple secondary inlet valve 11 requiring the occupant to transport hose 65 up and down the stairs or have a second hose 65 stored in a closet upstairs for cleaning on this upper level.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A vacuum valve assembly comprising:

a vacuum inlet valve housing connected with a conduit defining an open end;

a closure flap pivotably connected with the housing and configured to move from an open first position to a closed second position to cover and seal the open end;

a first surface on the closure flap that is offset generally parallel to a rear wall of the housing when the closure flap is in the open first position;

a second surface on the closure flap spaced from the first surface;

a sidewall extending from the second surface to the first surface;

a pull tab on the second surface of the closure flap, wherein the pull tab has a connected first end that is oriented in a manner such that the connected first end is positioned more radially outward from a center of the closure flap than a terminal free end;

a boss on the closure flap for pivoting about a pivot axis for the closure flap to move between the open first position and the closed second position.

2. The vacuum valve assembly of claim 1, wherein the sidewall extending from the second surface to the first surface is a tapered annular sidewall.

3. The vacuum valve assembly of claim 1, wherein the pull tab includes the connected first end that is connected to the second surface of the closure flap and the pull tab extends in a cantilevered manner.

4. The vacuum valve assembly of claim 1, wherein the closure flap is formed as a unitary unibody monolithic member.

5. The vacuum valve assembly of claim 1, further comprising:

a protrusion extending from the boss that is compressible during movement of the flap between the open first position and the closed second position adapted to selectively and releasably lock the closure flap in the open first position and the closed second position.

6. The vacuum valve assembly of claim 5, further comprising:

wherein the boss includes a convexly curved outer surface that is shaped complementarily to a concavely curved surface of a receiving area within a portion of the housing.

7. The vacuum valve assembly of claim 6, further comprising:

a concave recess defined in the concavely curved surface having a smaller radius of curvature than that of concave surface, wherein when the closure flap is in the closed second position, the protrusion fits within the concave recess.

8. The vacuum valve assembly of claim 1, further comprising: wherein the pull tab extends outward from the second surface and includes the connected first end that is connected with the second surface and the terminal free end, and the connected first end that is connected with the second surface adjacent a radial outermost edge of the second surface.

9. The vacuum valve assembly of claim 1, further comprising:

wherein the terminal free end is spaced slightly above or apart from the second surface; and when the closure flap is in the open first position, the pull tab is positioned closely adjacent the rear wall of the vacuum inlet valve housing.

10. The vacuum valve assembly of claim 1, further comprising:

wherein the open position of the closure flap is associated with being generally upright and vertical and parallel to to the rear wall of the vacuum inlet valve housing when the closure flap is opened.

11. The vacuum valve assembly of claim 1, wherein the pull tab contacts the rear wall of the vacuum inlet valve housing when the closure flap is in the open first position to preclude the second surface of the closure flap from contacting the rear wall.

12. The vacuum valve assembly of the claim 1, further comprising:

a lower end of the conduit defining the open end;

wherein the pivot axis is lower than the lower end of the conduit;

wherein the pivot axis is rearward from the open end relative to a front opening of the vacuum inlet valve housing.

13. The vacuum valve assembly of claim 1, wherein the second surface of closure flap has a larger surface area than the first surface of the closure flap.

14. The vacuum valve assembly of claim 13, wherein at least a portion of the second surface of the closure flap is not parallel to the first surface of the closure flap.

15. The vacuum valve assembly of claim 1, wherein the boss comprises:

two parallel sidewalls that are orthogonal to one of the first surface and the second surface of the closure flap, the boss defining an aperture extending between the two parallel sidewalls orthogonal to a longitudinal axis extending centrally through the conduit, wherein the pivot axis extends through the aperture and the pivot axis is orthogonal to the longitudinal axis.

16. The vacuum valve assembly of claim 15, wherein the boss further comprises:

a convex surface on the boss extending between the two parallel sidewalls.

17. The vacuum valve assembly of claim 16, wherein the boss further comprises:

a protrusion on the boss, and the protrusion extending radially outward from the convex surface on the boss relative to the pivot axis, wherein the protrusion is convexly curved and has a radius of curvature less than that of the convex surface on the boss.

18. The vacuum valve assembly of claim 1, wherein the pull tab is a cantilevered pull tab, wherein the connected first end is connected to the second surface of the closure flap adjacent an outer circumferential edge thereof and wherein the terminal free end is closer to a longitudinal axis extending centrally through the conduit than the connected first end and the terminal free end is spaced apart from the second surface of the closure flap.

19. A vacuum valve assembly comprising:

a vacuum inlet valve housing connected with a conduit defining an open end;

a closure flap pivotably connected with the housing and configured to move from an open first position to a closed second position to cover and seal the open end;

a first surface on the closure flap that is offset generally parallel to a rear wall of the housing when the closure flap is in the open first position;

a second surface on the closure flap spaced from the first surface;

a sidewall extending from the second surface to the first surface;

a pull tab on the second surface of the closure flap, wherein the pull tab has a connected first end that is oriented in a manner such that the connected first end is positioned more radially outward from a center of the closure flap than a terminal free end;

wherein the terminal free end is spaced slightly above or apart from the second surface, and when the closure flap is in the open first position, the pull tab is positioned closely adjacent the rear wall of the vacuum inlet valve housing; and a boss on the closure flap for pivoting about a pivot axis for the closure flap to move between the open first position and the closed second position.

* * * * *